US011066850B2

(12) United States Patent
Welbig et al.

(10) Patent No.: US 11,066,850 B2
(45) Date of Patent: Jul. 20, 2021

(54) ACCESS HANDLE FOR SLIDING DOORS

(71) Applicant: Amesbury Group, Inc., Amesbury, MA (US)

(72) Inventors: Tyler Welbig, Harrisburg, SD (US); Gary E. Tagtow, Sioux Falls, SD (US); Matt Halbersma, Brandon, SD (US); Michael Lee Anderson, Sioux Falls, SD (US)

(73) Assignee: Amesbury Group, Inc, Amesbury, MA (US)

( * ) Notice: Subject to any disclaimer, the term of this patent is extended or adjusted under 35 U.S.C. 154(b) by 439 days.

(21) Appl. No.: 16/045,161

(22) Filed: Jul. 25, 2018

(65) Prior Publication Data

US 2019/0032368 A1 Jan. 31, 2019

Related U.S. Application Data

(60) Provisional application No. 62/536,796, filed on Jul. 25, 2017.

(51) Int. Cl.
*E05B 47/02* (2006.01)
*E05B 47/00* (2006.01)
(Continued)

(52) U.S. Cl.
CPC ..... *E05B 47/0012* (2013.01); *E05B 47/02* (2013.01); *E05B 65/08* (2013.01);
(Continued)

(58) Field of Classification Search
CPC ..... E05B 9/002; E05B 47/00; E05B 47/0012; E05B 47/02; E05B 47/023; E05B 47/026;
(Continued)

(56) References Cited

U.S. PATENT DOCUMENTS 333,093 A 12/1885 Wright
419,384 A 1/1890 Towne
(Continued)

FOREIGN PATENT DOCUMENTS

AU 84928 12/2020
CA 2631521 11/2009
(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — Christopher J Boswell

(57) ABSTRACT

A lock actuator assembly includes an escutcheon defining a longitudinal axis. A rotatable drive disk is rotatably coupled to the escutcheon about a rotational axis. A slide arm is slidingly coupled to the escutcheon and operably coupled to the drive disk such that movement of the slide arm along the longitudinal axis rotates the drive disk about the rotational axis. Additionally, an electronic actuator is coupled to the escutcheon. The electronic actuator is configured to drive the slide arm along the longitudinal axis, and the drive disk is adapted to couple to a lock mechanism so as to shift the lock mechanism between a locked position and an unlocked position when the drive disk rotates about the rotational axis.

20 Claims, 12 Drawing Sheets

(51) Int. Cl.
*E05B 65/08* (2006.01)
*G07C 9/00* (2020.01)
*E05B 17/10* (2006.01)

(52) U.S. Cl.
CPC ..... *G07C 9/00182* (2013.01); *E05B 17/10* (2013.01); *E05B 2047/0014* (2013.01); *E05B 2047/0016* (2013.01); *E05B 2047/0023* (2013.01); *E05B 2047/0097* (2013.01); *G07C 2209/62* (2013.01)

(58) Field of Classification Search
CPC ..... E05B 2047/0013; E05B 2047/0014; E05B 2047/0015; E05B 2047/0016; E05B 2047/0023; E05B 2047/0053; E05B 2047/0069; E05B 2047/0094; E05B 2047/0095; E05B 63/14; E05B 63/143
See application file for complete search history.

(56) References Cited

U.S. PATENT DOCUMENTS 651,947 A 6/1900 Johnson
738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A 1/1956 Pelcin
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Fontana Giampiero
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,135,377 A * 1/1979 Kleefeldt ..... E05B 81/25 292/144
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourne
4,607,510 A 8/1986 Shanaan et al.
4,633,688 A * 1/1987 Beudat ..... E05B 47/0012 292/142
4,639,025 A 1/1987 Fann
4,643,005 A 2/1987 Logas
4,691,543 A 9/1987 Watts
4,704,880 A 11/1987 Schlindwein
4,717,909 A 1/1988 Davis
4,754,624 A 7/1988 Fleming et al.
4,768,817 A 9/1988 Fann
4,893,849 A 1/1990 Schlack
4,913,475 A 4/1990 Bushnell et al.
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A 9/1992 Wallden
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A 3/1995 Hotzi
5,404,737 A 4/1995 Hotzl
5,441,315 A * 8/1995 Kleefeldt ..... E05B 81/25 292/201
5,456,503 A 10/1995 Russell et al.
5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes
5,516,160 A 5/1996 Kajuch
5,524,941 A 6/1996 Fleming
5,524,942 A 6/1996 Fleming
5,544,924 A 8/1996 Paster
5,603,534 A 2/1997 Fuller
5,609,372 A 3/1997 Ponelle
5,620,216 A 4/1997 Fuller
5,707,090 A 1/1998 Sedley
5,716,154 A 2/1998 Miller et al.
5,722,704 A 3/1998 Chaput et al.

(56) References Cited

U.S. PATENT DOCUMENTS 5,728,108 A 3/1998 Griffiths et al.
5,735,559 A 4/1998 Frolov
5,757,269 A 5/1998 Roth
5,782,114 A 7/1998 Zeus et al.
5,791,700 A 8/1998 Biro
5,820,170 A 10/1998 Clancy
5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,911,763 A 6/1999 Quesada
5,915,764 A 6/1999 MacDonald
5,918,916 A 7/1999 Kajuch
5,946,956 A 9/1999 Hotzl
5,951,068 A 9/1999 Strong et al.
5,979,199 A * 11/1999 Elpern ..... G07C 9/00182 292/201
6,050,115 A 4/2000 Schroter et al.
6,079,585 A 6/2000 Lentini
6,089,058 A * 7/2000 Elpern ..... G07C 9/00182 292/336.3
6,094,869 A 8/2000 Magoon et al.
6,098,433 A 8/2000 Manaici
6,112,563 A 9/2000 Ramos
6,116,067 A * 9/2000 Myers ..... B25H 3/028 292/341.16
6,120,071 A 9/2000 Picard
D433,916 S 11/2000 Frey
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 9/2002 Su
6,457,751 B1 10/2002 Hartman
6,490,895 B1 12/2002 Weinerman
6,502,435 B2 1/2003 Watts et al.
6,516,641 B1 2/2003 Segawa
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber
6,672,632 B1 1/2004 Speed et al.
6,688,656 B1 2/2004 Becken
6,733,051 B1 5/2004 Cowper
6,776,441 B2 8/2004 Liu
6,810,699 B2 11/2004 Nagy
6,813,916 B2 11/2004 Chang
6,871,451 B2 3/2005 Harger et al.
6,905,152 B1 6/2005 Hudson
6,929,293 B2 8/2005 Tonges
6,935,662 B1 8/2005 Hauber et al.
6,962,377 B2 11/2005 Tonges
6,971,686 B2 12/2005 Becken
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,052,054 B2 * 5/2006 Luker ..... E05B 47/0607 292/201
7,083,206 B1 8/2006 Johnson
7,128,350 B2 10/2006 Eckerdt
7,152,441 B2 * 12/2006 Friar ..... E05B 47/0012 70/78
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 7/2008 Walls et al.
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton
7,963,573 B2 6/2011 Blomqvist
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 3/2013 Nakanishi et al.
8,403,376 B2 3/2013 Greiner
8,494,680 B2 7/2013 Sparenberg et al.
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 11/2014 Denison
8,899,635 B2 12/2014 Nakanishi
8,922,370 B2 12/2014 Picard
8,939,474 B2 1/2015 Hagemeyer et al.
9,057,210 B2 6/2015 Dumas et al.
9,196,104 B2 11/2015 Dumas et al.
9,218,696 B2 12/2015 Dumas et al.
9,428,937 B2 8/2016 Tagtow et al.
9,482,035 B2 11/2016 Wolf
9,512,654 B2 12/2016 Armari et al.
9,605,444 B2 3/2017 Rickenbaugh
9,637,957 B2 5/2017 Hagemeyer et al.
9,758,997 B2 9/2017 Hagemeyer et al.
9,765,550 B2 9/2017 Hemmingsen et al.
9,790,716 B2 10/2017 Hagemeyer et al.
9,822,552 B2 11/2017 Eller et al.
10,174,522 B2 * 1/2019 Denison ..... E05B 47/026
10,240,366 B2 3/2019 Sotes Delgado
10,246,914 B2 4/2019 Sieglaar
10,822,836 B2 * 11/2020 Nakasone ..... E05B 63/0052
2002/0104339 A1 8/2002 Saner
2003/0024288 A1 2/2003 Gokcebay et al.
2003/0159478 A1 8/2003 Nagy
2004/0004360 A1 1/2004 Huang
2004/0011094 A1 1/2004 Hsieh
2004/0066046 A1 4/2004 Becken
2004/0089037 A1 5/2004 Chang

(56) References Cited

U.S. PATENT DOCUMENTS

| | | | |
|---|---|---|---|
| 2004/0107746 | A1 | 6/2004 | Chang |
| 2004/0107747 | A1 | 6/2004 | Chang |
| 2004/0112100 | A1 | 6/2004 | Martin |
| 2004/0145189 | A1 | 7/2004 | Liu |
| 2004/0227349 | A1 | 11/2004 | Denys |
| 2004/0239121 | A1 | 12/2004 | Morris |
| 2005/0029345 | A1 | 2/2005 | Waterhouse |
| 2005/0044908 | A1 | 3/2005 | Min |
| 2005/0050928 | A1 | 3/2005 | Frolov |
| 2005/0103066 | A1 | 5/2005 | Botha et al. |
| 2005/0144848 | A1 | 7/2005 | Harger et al. |
| 2005/0166647 | A1 | 8/2005 | Walls |
| 2005/0180562 | A1 | 8/2005 | Chiang |
| 2005/0229657 | A1 | 10/2005 | Johansson et al. |
| 2006/0043742 | A1 | 3/2006 | Huang |
| 2006/0071478 | A1 | 4/2006 | Denys |
| 2006/0076783 | A1 | 4/2006 | Tsai |
| 2006/0150516 | A1 | 7/2006 | Hagemeyer |
| 2006/0208509 | A1 | 9/2006 | Bodily |
| 2007/0068205 | A1 | 3/2007 | Timothy |
| 2007/0080541 | A1 | 4/2007 | Fleming |
| 2007/0113603 | A1 | 5/2007 | Polster |
| 2007/0170725 | A1 | 7/2007 | Speyer et al. |
| 2007/0259551 | A1 | 11/2007 | Rebel |
| 2008/0000276 | A1 | 1/2008 | Huang |
| 2008/0001413 | A1 | 1/2008 | Lake |
| 2008/0087052 | A1 | 4/2008 | Abdollahzadeh et al. |
| 2008/0092606 | A1 | 4/2008 | Meekma |
| 2008/0093110 | A1 | 4/2008 | Bagung |
| 2008/0141740 | A1 | 6/2008 | Shvartz |
| 2008/0150300 | A1 | 6/2008 | Harger et al. |
| 2008/0156048 | A1 | 7/2008 | Topfer |
| 2008/0156049 | A1 | 7/2008 | Topfer |
| 2008/0157544 | A1 | 7/2008 | Phipps |
| 2008/0178530 | A1 | 7/2008 | Ellerton et al. |
| 2008/0179893 | A1 | 7/2008 | Johnson |
| 2008/0184749 | A1 | 8/2008 | Alber et al. |
| 2008/0191499 | A1 | 8/2008 | Stein |
| 2009/0064737 | A1 | 3/2009 | Fan |
| 2009/0078011 | A1 | 3/2009 | Avni |
| 2009/0218832 | A1 | 9/2009 | Mackle |
| 2009/0314042 | A1 | 12/2009 | Fan |
| 2009/0315669 | A1 | 12/2009 | Lang |
| 2010/0107707 | A1 | 5/2010 | Viviano |
| 2010/0154490 | A1 | 6/2010 | Hagemeyer et al. |
| 2010/0213724 | A1 | 8/2010 | Uyeda |
| 2010/0236302 | A1 | 9/2010 | Uyeda |
| 2010/0313612 | A1 | 12/2010 | Eichenstein |
| 2010/0327610 | A1 | 12/2010 | Nakanishi et al. |
| 2011/0056254 | A1 | 3/2011 | Tsai |
| 2011/0198867 | A1 | 8/2011 | Hagemeyer et al. |
| 2011/0289987 | A1 | 12/2011 | Chiou et al. |
| 2011/0314877 | A1 | 12/2011 | Fang |
| 2012/0001443 | A1 | 1/2012 | Mitchell |
| 2012/0146346 | A1 | 6/2012 | Hagemeyer et al. |
| 2012/0235428 | A1 | 9/2012 | Blacklaws et al. |
| 2012/0306220 | A1 | 12/2012 | Hagemeyer et al. |
| 2013/0019643 | A1 | 1/2013 | Tagtow et al. |
| 2013/0081251 | A1 | 4/2013 | Hultberg |
| 2013/0140833 | A1 | 6/2013 | Hagemeyer et al. |
| 2013/0152647 | A1 | 6/2013 | Terei et al. |
| 2013/0200636 | A1 | 8/2013 | Hagemeyer et al. |
| 2013/0234449 | A1 | 9/2013 | Dery et al. |
| 2013/0276488 | A1 | 10/2013 | Haber |
| 2014/0060127 | A1 | 3/2014 | Hemmingsen et al. |
| 2014/0125068 | A1 | 5/2014 | Hagemeyer et al. |
| 2014/0159387 | A1 | 6/2014 | Hagemeyer et al. |
| 2014/0182343 | A1 | 7/2014 | Talpe |
| 2014/0367978 | A1 | 12/2014 | Geringer |
| 2015/0075233 | A1 | 3/2015 | Pluta |
| 2015/0089804 | A1 | 4/2015 | Picard |
| 2015/0114176 | A1 | 4/2015 | Bisang |
| 2015/0170449 | A1 | 6/2015 | Chandler, Jr. |
| 2015/0176311 | A1 | 6/2015 | Picard |
| 2015/0252595 | A1 | 9/2015 | Hagemeyer et al. |
| 2016/0083976 | A1 | 3/2016 | Rickenbaugh |
| 2016/0108650 | A1 | 4/2016 | Hagemeyer et al. |
| 2016/0369525 | A1 | 12/2016 | Tagtow et al. |
| 2018/0023320 | A1 | 1/2018 | McKibben |
| 2018/0051478 | A1 | 2/2018 | Tagtow |
| 2018/0051480 | A1 | 2/2018 | Tagtow |
| 2018/0119462 | A1 | 5/2018 | Hagemeyer |
| 2018/0155962 | A1 | 6/2018 | Mitchell et al. |
| 2018/0298642 | A1 | 10/2018 | Tagtow |
| 2018/0313116 | A1 | 11/2018 | Criddle |
| 2019/0024437 | A1 | 1/2019 | Tagtow |
| 2019/0277062 | A1 | 9/2019 | Tagtow |
| 2020/0354990 | A1 | 11/2020 | Tagtow |

FOREIGN PATENT DOCUMENTS

| | | | |
|---|---|---|---|
| CN | 1243908 | | 2/2000 |
| CN | 2554288 | Y | 6/2003 |
| CN | 2595957 | Y | 12/2003 |
| CN | 2660061 | | 12/2004 |
| CN | 201031548 | Y | 3/2008 |
| CN | 202047652 | U | 11/2011 |
| DE | 1002656 | | 2/1957 |
| DE | 1584112 | | 9/1969 |
| DE | 2639065 | | 3/1977 |
| DE | 3032086 | | 3/1982 |
| DE | 3836693 | | 5/1990 |
| DE | 9011216 | | 10/1990 |
| DE | 4224909 | | 2/1993 |
| DE | 29807860 | | 8/1998 |
| DE | 20115378 | U1 | 11/2001 |
| DE | 10253240 | | 5/2004 |
| DE | 202010002544 | U1 | 8/2011 |
| DE | 202012002743 | U1 | 4/2012 |
| DE | 202013000920 | U1 | 4/2013 |
| DE | 202013000921 | U1 | 4/2013 |
| DE | 202013001328 | U1 | 5/2013 |
| EP | 0007397 | A1 | 2/1980 |
| EP | 0231042 | A2 | 8/1987 |
| EP | 0268750 | | 6/1988 |
| EP | 341173 | | 11/1989 |
| EP | 359284 | | 3/1990 |
| EP | 661409 | | 7/1995 |
| EP | 792987 | | 9/1997 |
| EP | 1106761 | | 6/2001 |
| EP | 1283318 | | 2/2003 |
| EP | 1449994 | | 8/2004 |
| EP | 1574642 | | 9/2005 |
| EP | 1008712 | B1 | 2/2006 |
| EP | 1867817 | | 12/2007 |
| EP | 2128362 | | 12/2009 |
| EP | 2273046 | A2 | 1/2011 |
| EP | 2339099 | A1 | 6/2011 |
| EP | 2450509 | | 5/2012 |
| EP | 2318624 | B1 | 12/2012 |
| EP | 2318625 | B1 | 3/2013 |
| EP | 2581531 | A1 | 4/2013 |
| EP | 2584123 | A1 | 4/2013 |
| EP | 2584124 | A2 | 4/2013 |
| EP | 2998483 | | 3/2016 |
| EP | 3091152 | A1 | 11/2016 |
| FR | 363424 | | 7/1906 |
| FR | 370890 | | 2/1907 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2344695 | | 10/1977 |
| FR | 2502673 | | 10/1982 |
| FR | 2342390 | | 9/1997 |
| FR | 2848593 | | 2/2005 |
| FR | 3017641 | | 8/2015 |
| GB | 226170 | | 4/1925 |
| GB | 264373 | A | 1/1927 |
| GB | 583655 | | 12/1946 |
| GB | 612094 | A | 11/1948 |
| GB | 1498849 | | 1/1978 |
| GB | 1575900 | | 10/1980 |

(56) References Cited

FOREIGN PATENT DOCUMENTS

| | | | |
|---|---|---|---|
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 02/33202 | | 4/2002 |
| WO | 2007/104499 | | 9/2007 |
| WO | 2010071886 | | 6/2010 |
| WO | 2015/079290 | | 6/2015 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"uPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access-control/electricocks-strikes-deadbolts, 2 pages, Feb. 2016.

magneticlocks.net—Electric Strikes and Deadbolts; printed from https://www.magneticlocks.net/electric-strikes-and-deadbolts/electric-strikes.html, 8 pages, Feb. 2016.

sdcsecurity.com—Latch and Deadbolt Monitoring Strikes; printed from http://www.sdcsecurity.com/monitor-strike-kits2.htm, 2 pages, Feb. 2016

* cited by examiner

ACCESS HANDLE FOR SLIDING DOORS

CROSS-REFERENCE TO RELATED APPLICATIONS

This application claims priority to and the benefit of U.S. Provisional Patent Application No. 62/536,796, filed on Jul. 25, 2017, the disclosure of which is hereby incorporated by reference in its entirety.

INTRODUCTION

Sliding doors, such as patio doors, commonly utilize locking devices on the locking stile that engage keepers mounted on the jamb frame to provide environmental control and security, and to prevent unintentional opening of the doors. Projecting handles, interior thumb-turns, and exterior key cylinders are commonly used devices to manually actuate the locking devices between locked and unlocked conditions and may also be used as a handgrip to slide the door open or closed.

SUMMARY

In an aspect, the technology relates to a lock actuator assembly including: an escutcheon defining a longitudinal axis; a rotatable drive disk rotatably coupled to the escutcheon about a rotational axis; a slide arm slidingly coupled to the escutcheon and operably coupled to the drive disk, wherein movement of the slide arm along the longitudinal axis rotates the drive disk about the rotational axis; and an electronic actuator coupled to the escutcheon, wherein the electronic actuator is configured to drive the slide arm along the longitudinal axis, and wherein the drive disk is adapted to couple to a lock mechanism so as to shift the lock mechanism between a locked position and an unlocked position when the drive disk rotates about the rotational axis.

In an example, the electronic actuator includes: an electronic motor; a leadscrew coupled to the motor; and a nut threadably engaged with the leadscrew and coupled to the slide arm, wherein the motor selectively drives rotation of the leadscrew such that the nut moves along the longitudinal axis and induces the movement of the slide arm. In another example, the leadscrew extends in a direction substantially parallel to the longitudinal axis. In yet another example, the nut includes a post engaged with an opening defined in the slide arm. In still another example, the opening is elongated along the longitudinal axis. In an example, the electronic actuator further includes a sensor configured to determine a position of the nut along the longitudinal axis.

In another example, a control element is operatively coupled to the electronic actuator. In yet another example, a notification system is operatively coupled to the electronic actuator. In still another example, the escutcheon is an interior escutcheon, and the lock actuator assembly further includes an exterior escutcheon including the control element and the notification system. In an example, a thumb slide is coupled to the slide arm and the thumb slide is configured to move along the longitudinal axis and induces the movement of the slide arm. In another example, a key cylinder is coupled to the slide arm and rotation of the key cylinder is configured to move the slide arm along the longitudinal axis.

In another aspect, a lock actuator assembly includes: an escutcheon; a lock drive mounted to the escutcheon and adapted to couple to a lock mechanism; and an electronic actuator mounted to the escutcheon and coupled to the lock drive, wherein the electronic actuator is configured to move the lock drive between at least two positions, a first position corresponding to a locked position of the lock mechanism and a second position corresponding to an unlocked position of the lock mechanism.

In an example, the electronic actuator includes a rotatable leadscrew and a nut threadably engaged to the leadscrew and coupled to the lock drive, wherein the nut is moveable between three positions, a locking position, an unlocking position, and a center position, wherein when the nut moves towards the locking position, the lock drive moves to the first position, and when the nut moves towards the unlocking position, the lock drive moves to the second position, and wherein the nut returns to the center position after the locking position and the unlocking position. In another example, the electronic actuator includes a control element, and when the control element is activated, the electronic actuator searches for a security device before moving the lock drive. In yet another example, the electronic actuator further includes at least one antenna configured to detect the security device. In still another example, the electronic actuator includes a notification system configured to display at least one status condition of the electronic actuator. In an example, at least one of a thumb slide is mounted to the escutcheon and coupled to the lock drive and a key cylinder is coupled to the lock drive.

In another aspect, the technology relates to a method of operating a lock mechanism including: receiving an activation signal from a control element at an electronic actuator, wherein the control element is disposed on an exterior escutcheon of a lock actuator assembly and the electronic actuator is disposed on an interior escutcheon of the lock actuator assembly; detecting, by the electronic actuator, a presence of a security device relative to the lock actuator assembly; determining, by the electronic actuator, a position of the security device relative to the lock actuator assembly; determining, by the electronic actuator, an authorization of the security device; and moving a lock drive mounted to the interior escutcheon and coupled to the lock mechanism based on the security device being (i) positioned proximate the lock actuator assembly; (ii) located at the exterior escutcheon; and (iii) authorized to operate the lock actuator assembly, wherein the electronic actuator includes a motor coupled to the lock drive such that the lock drive linearly and rotationally moves to operate the lock mechanism.

In an example, the method further includes displaying a visual signal from a notification system disposed on the exterior escutcheon based on at least one status condition of the electronic actuator. In another example, moving the lock drive includes linearly moving a nut coupled to the lock drive along a rotating leadscrew, and wherein after moving the lock mechanism to one of a locked position and an unlocked position, the nut returns to a center position.

BRIEF DESCRIPTION OF THE DRAWINGS

There are shown in the drawings, examples which are presently preferred, it being understood, however, that the technology is not limited to the precise arrangements and instrumentalities shown.

DETAILED DESCRIPTION

Figure 1:
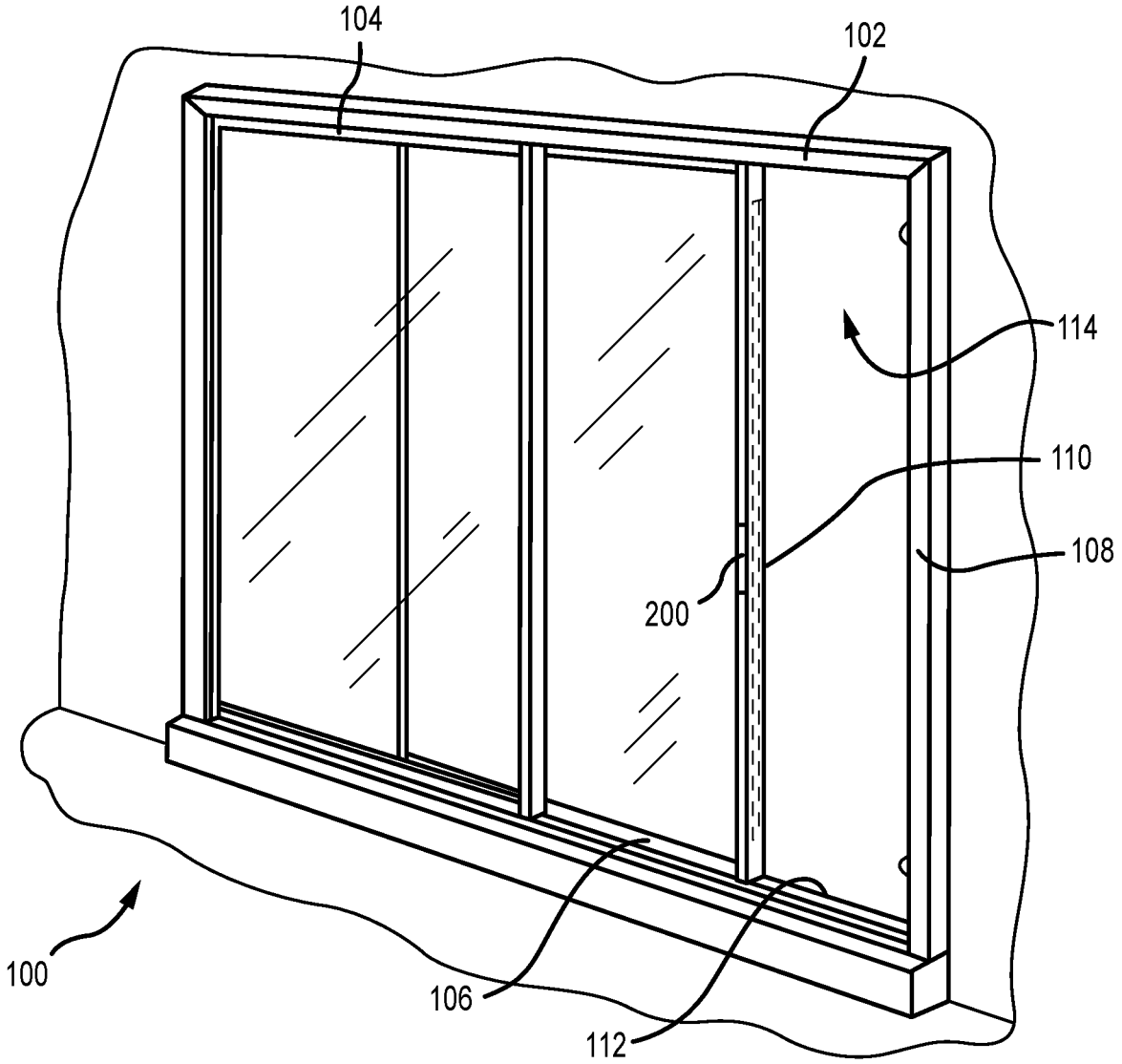
FIG. 1 is a perspective view of a sliding door assembly.

FIG. 1 is a perspective view of a sliding door assembly 100. In the example, the sliding door assembly 100 includes a frame 102, a fixed door panel 104, and a sliding door panel 106. The frame 102 includes a jamb 108 that the door panels 104, 106 are mounted within. The sliding door panel 106 includes a side stile 110, and is laterally slidable in tracks 112 to open and close an opening 114 defined by the frame 102. A lock assembly 200 is disposed on the side stile 110 and enables the sliding door panel 106 to be locked and unlocked from either an exterior side or an interior side.

Figure 2:
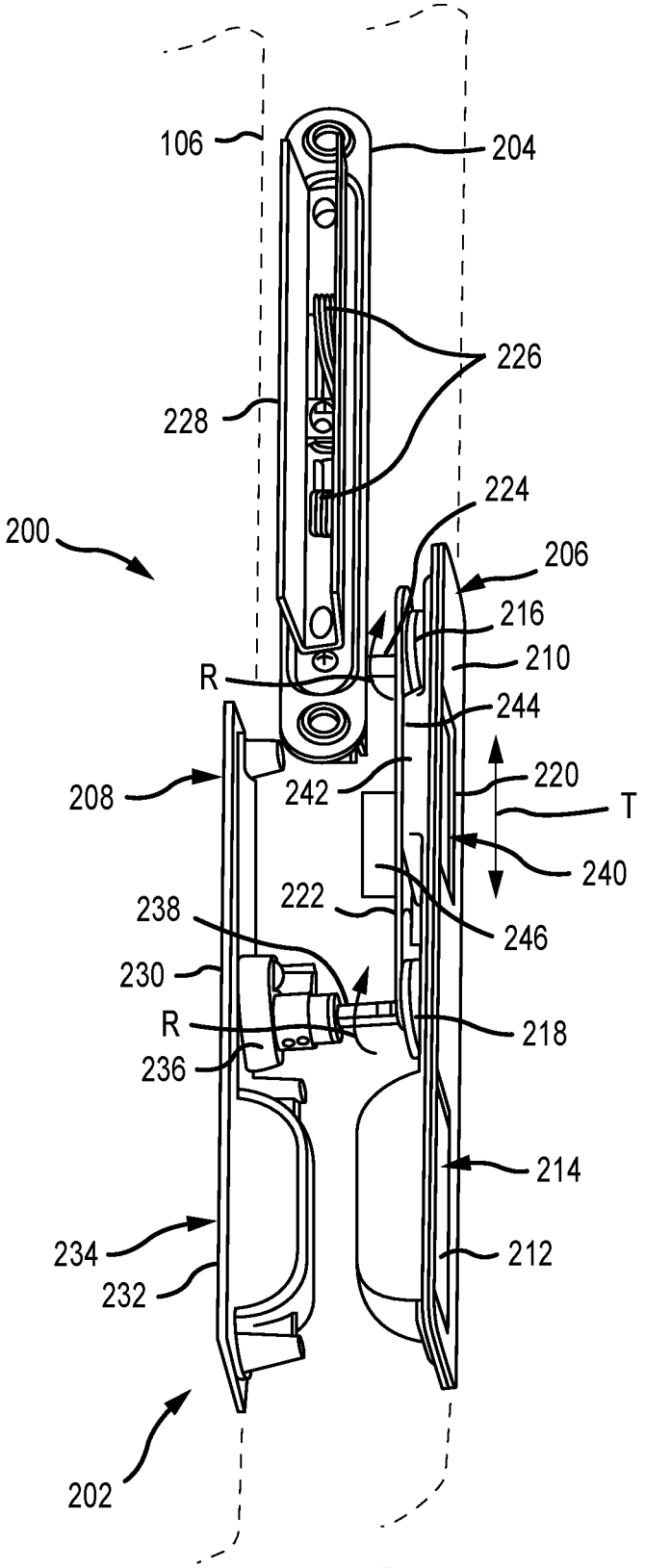
FIG. 2 is a perspective view of a lock assembly for use with the sliding door assembly of FIG. 1, with a sliding door depicted in phantom.

FIG. 2 is a perspective view of the lock assembly 200 for use with the sliding door assembly 100 (shown in of FIG. 1), with the sliding door 106 depicted in phantom. The lock assembly 200 includes a lock actuator assembly 202 that is operationally coupled to a lock mechanism 204. The lock actuator assembly 202 can include an interior lock actuator assembly 206 and an exterior lock actuator assembly 208. The interior lock actuator assembly 206 is configured to be mounted on an inwardly facing surface of the side stile of the sliding door panel 106. In the example, the interior lock actuator assembly 206 includes an interior escutcheon 210 defining a handle 212 that is recessed 214 within the sliding door 106. The interior escutcheon 210 is configured to receive or otherwise support components, including a rotatable lock mechanism drive disk 216, a rotatable key drive disk 218, a slidable thumb slide 220, and a slidable slide arm 222.

The lock mechanism drive disk 216 is coupled to the lock mechanism 204 via a lock drive tail 224 that extends from the drive disk 216. In the example, the lock mechanism 204 includes a pair of hooks 226 that are selectively extendable and retractable in regards to a keeper 228 to lock and unlock the lock assembly 200 by rotation of the drive tail 224 and the drive disk 216. The lock mechanism 204 may be a mortise lock as illustrated in FIG. 2 or can be any other single-point or multi-point lock as required or desired. For example, the lock mechanism 204 may be one of the Nexus Lock, the Gemini Lock, or the 2300/2320 Mortise Lock manufactured and sold by Amesbury Group, Inc.

The exterior lock actuator assembly 208 is configured to be mounted on an outwardly facing surface of the side stile of the sliding door panel 106. In the example, the exterior lock actuator assembly 208 includes an exterior escutcheon 230 defining a handle 232 that is recessed 234 within the sliding door 106. The exterior escutcheon 230 is configured to support components, including a key cylinder 236. The key cylinder 236 is coupled to the interior lock actuator assembly 206 by a key drive tail 238 that extends from the key drive disk 218. The key cylinder 236 enables for the sliding door 106 to be locked and unlocked, via the lock mechanism 204, from the exterior side of the door. Additionally, to lock and unlock the lock mechanism 204 on the interior side of the door 106, the thumb slide 220 may be utilized. The thumb slide 220 is received within a corresponding recess 240 defined by an enclosure 242 of the interior escutcheon 210 and is coupled to the slide arm 222. The thumb slide 220 provides an interior control for operating the lock assembly 200. The slide arm 222 includes an elongate plate 244 that extends between, and is coupled with, the lock mechanism drive disk 216 and the key drive disk 218 to provide a link between a user input of a rotational movement R of the key drive disk 218 or a translation movement T of the thumb slide 220 and a resulting rotational output movement R of the lock mechanism drive disk 216.

In operation, the lock assembly 200 can be operated from an interior side or an exterior side of the door. To unlock from the interior side, the thumb slide 220 is actuated in a translational direction T, and since the thumb slide 220 is directly coupled to the slide arm 222, a corresponding translational movement is induced into the slide arm 222. When the slide arm 222 translationally moves, the lock mechanism drive disk 216 is rotated R, which turns drive tail 224 and actuates the lock mechanism 204 to extend or retract the hooks 226. To operate from the exterior side, a key within the key cylinder 236 causes rotation R of the key drive disk 218 via the drive tail 238. Rotation of the key drive disk 218 induces corresponding translation movement of into the slide arm 222, and when the slide arm 222 translationally moves, the lock mechanism drive disk 216 is rotated R as described above. The lock assembly 200 is generally described in U.S. Pat. No. 9,482,035, entitled "RECESSED LOCK ACTUATING DEVICE FOR SLIDING DOORS," the disclosure of which is hereby incorporated by reference herein in its entirety. However, in this example, the slide arm 222 can additionally or alternatively be remotely actuated by an electronic actuator 246, which is described further below.

By including the electronic actuator 246, the sliding door panel 106 is enabled to be locked and unlocked from either the exterior or interior side without use of a manual key within the key cylinder 236 or the thumb slide 220. The electronic actuator 326 is configured to motorize the locking and unlocking of the lock mechanism 204 so that only a control element (e.g., a button or touch pad) needs to be pressed. Additionally, to provide security to the lock assembly 200, access control authentication for the control element may be provided by a security device 354 (shown in FIGS. 4A and 4B). For example, the security device may be a mobile device such as a phone or a key fob that can communicate with the electronic actuator 246 by sending communication signals through wireless communication protocols (e.g., Bluetooth communication protocols). Accordingly, use of a physical key is no longer necessary to unlock the sliding door 106. This enables multiple users (e.g., a family) to each have access without the possibility of physical keys being lost or stolen. Additionally, controlled access (e.g., for one time access, a set number of uses, or a set day or time of day) can be set up so that users, such as dog walkers, house sitters, or cleaners can have limited access through the sliding door 106. Furthermore, records of who accessed the door 106 and at what time may be compiled and/or stored.

Figure 3A:
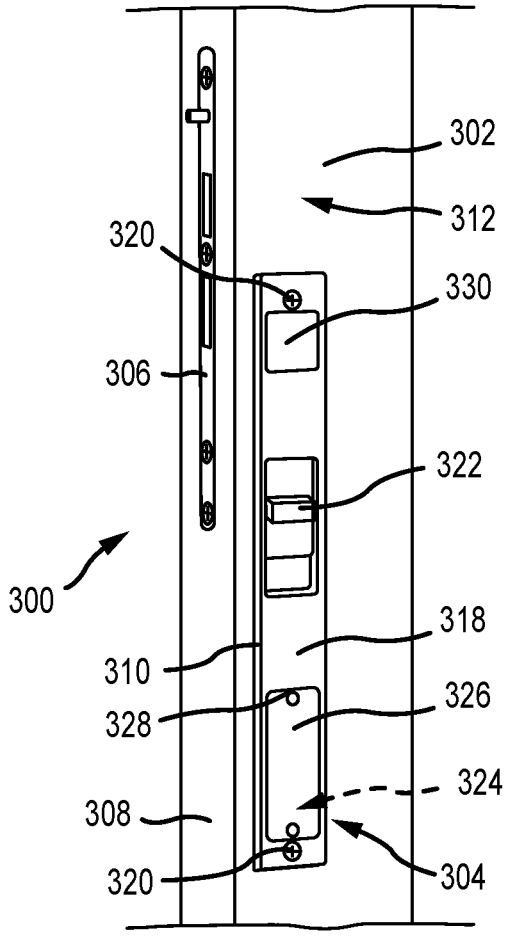
FIGS. 3A and 3B are perspective views of an exemplary lock assembly mounted on a sliding door.
Figure 3B:
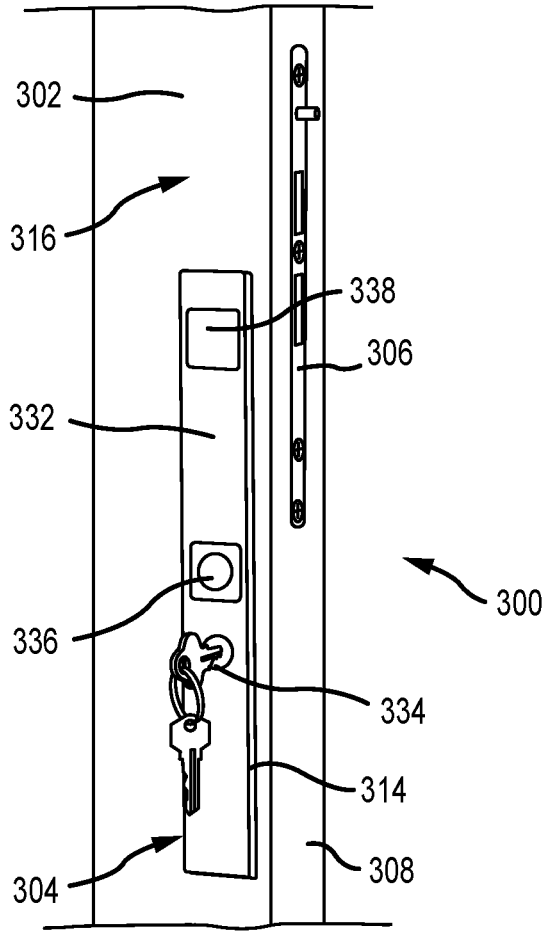

FIGS. 3A and 3B are perspective views of an exemplary lock assembly 300 mounted on a sliding door 302. Referring concurrently to FIGS. 3A and 3B, the lock assembly 300 includes a lock actuator assembly 304 that drives operation of a lock mechanism 306 that is mounted to a stile 308 of the door 302 as described above. The lock actuator assembly 304 includes an interior lock actuator assembly 310 that is mounted on an interior surface 312 of the door 302 as illustrated in FIG. 3A, and an exterior lock actuator assembly 314 that is mounted on an exterior surface 316 of the door 302 as illustrated in FIG. 3B. The interior lock actuator assembly 310 includes an interior escutcheon 318 that is secured to the door 302 by one or more fasteners 320 connecting the interior escutcheon 318 to the exterior lock actuator assembly 314. The interior escutcheon 318 supports a thumb slide 322 that is configured to manually lock and unlock the lock mechanism 306. In this example, the interior escutcheon 318 includes a power source compartment 324 that houses a power source for an electronic actuator 342 (shown in FIGS. 4A and 4B). A removable cover 326 enables access to the power source compartment 324 by one or more fasteners 328. Additionally, a device sensor 330 is mounted on the interior escutcheon 318. The device sensor 330 is configured to communicate with and detect a security device 354 (shown in FIGS. 4A and 4B) and described further below.

The exterior lock actuator assembly 314 includes an exterior escutcheon 332 that is secured to the interior escutcheon 318 by the fasteners 320. Because the mounting fasteners 320 are not disposed on the exterior side of the door 302, undesirable access into the lock assembly 300 is restricted and/or prevented. The exterior escutcheon 332 supports a key cylinder 334 that is configured to manually lock and unlock the lock mechanism 306. Additionally, the exterior escutcheon 332 includes a control element 336 that is configured to activate the lock actuator assembly 304 and automatically lock and unlock the lock mechanism 306, via the electronic actuator 342, and as described further below in reference to FIGS. 4A and 4B. The control element 336 enables access through the door 302 without requiring physical keys to turn the key cylinder 334. In the example, the control element 336 may be a touch pad (as illustrated) or can be a button, an infrared beam, etc. that enables for a signal to be sent to the electronic actuator when a user is at the exterior escutcheon 332. The control element 336 may require input from the user, such as pressing the touch pad or button, or may be automatic like the infrared beam that detects the presence of the user. The exterior escutcheon 332 may also include a notification system 338 that is configured to display at least one status condition of the lock assembly 300. The notification system 338 is described further below in reference to FIG. 8. In other examples, one or more of the interior escutcheon 118 and the exterior escutcheon 332 may include an integral handle as described in FIG. 2 or may utilize a remote (e.g., separate component) handle as require or desired to slide the sliding door.

Figure 4A:
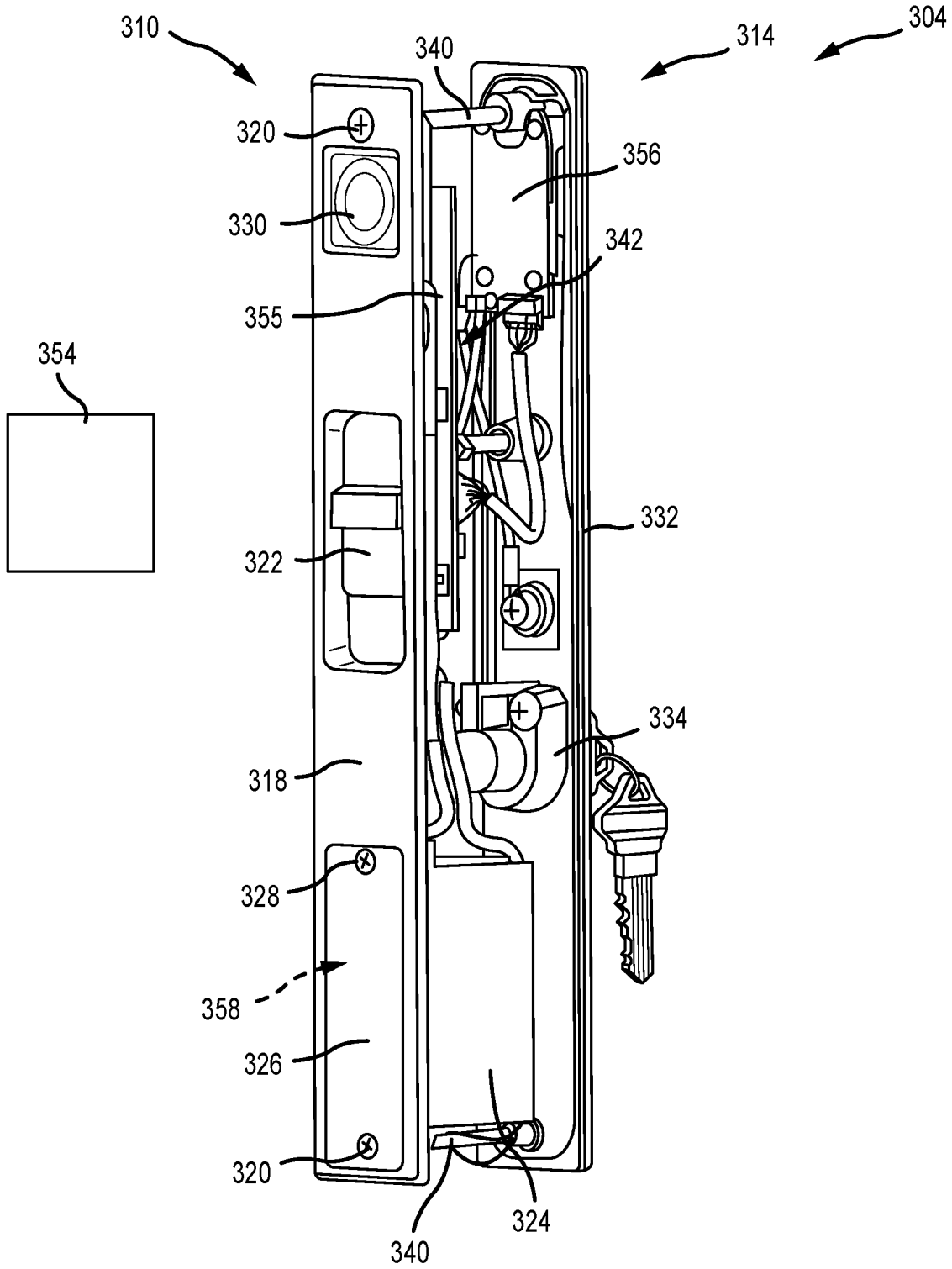
FIGS. 4A and 4B are interior and exterior perspective views, respectively, of a lock actuator assembly.
Figure 4B:
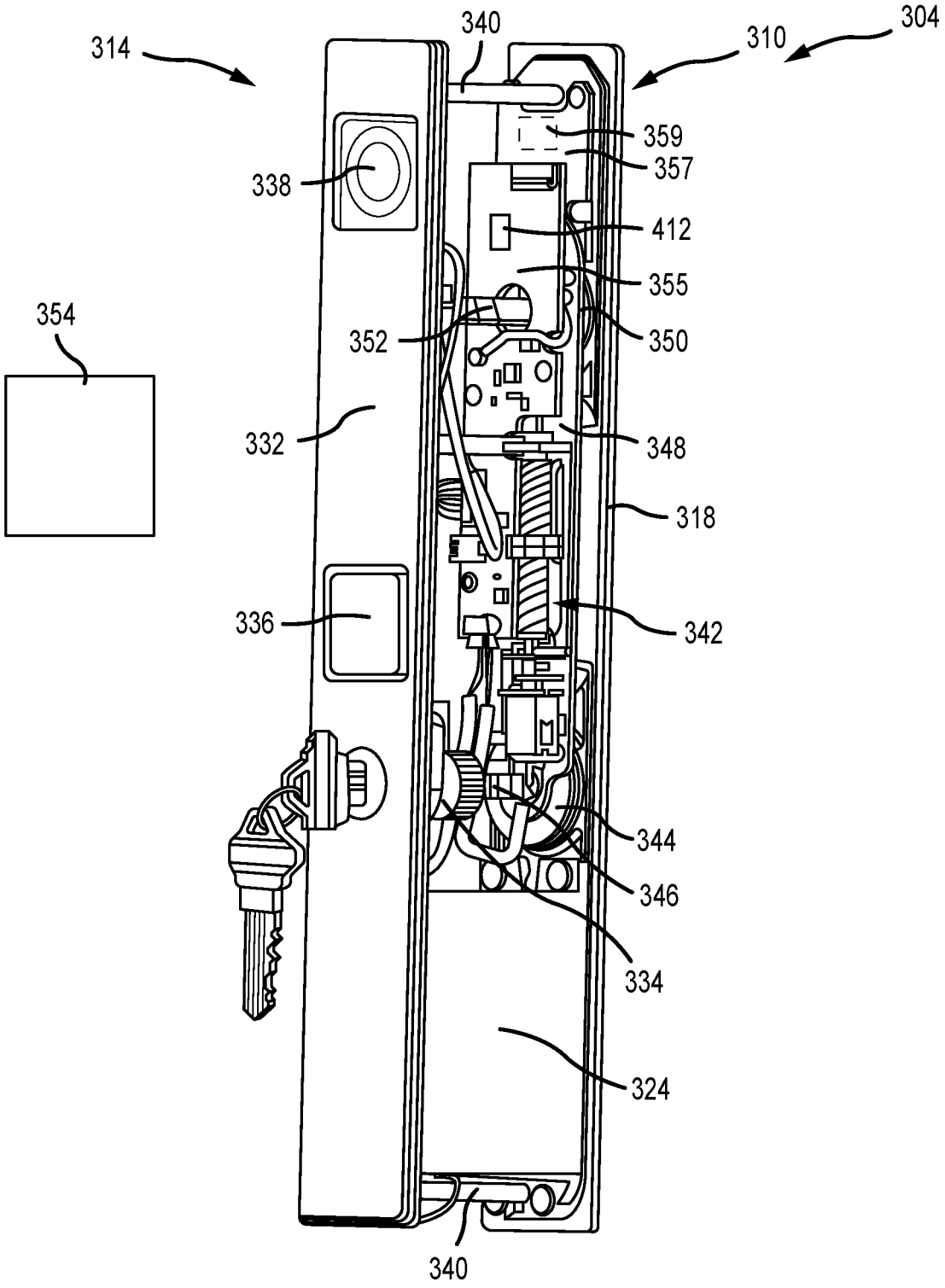

FIGS. 4A and 4B are interior and exterior perspective views, respectively, of the lock actuator assembly 304. Referring concurrently to FIGS. 4A and 4B, the interior lock actuator assembly 310 can be connected to the exterior lock actuator assembly 314 by the fasteners 320 and a post 340 extending between the interior escutcheon 318 and the exterior escutcheon 332. Positioned between the interior escutcheon 318 and the exterior escutcheon 332, the lock actuator assembly 304 includes an electronic actuator 342 that is configured to automatically lock and unlock the lock mechanism 306 (shown in FIGS. 3A and 3B) upon activation of the control element 336. The electronic actuator 342 also works in cooperation with the thumb slide 322 and the key cylinder 334 so that the lock actuator assembly 304 may also be manually operable as required or desired.

In operation, the lock actuator assembly 304 can lock and unlock the lock mechanism (not shown for clarity) by either manually actuating the key cylinder 334 disposed on the exterior facing side of the assembly 304 or the thumb slide 322 disposed on the interior facing side of the assembly 304. For example and as described above, turning the key cylinder 334 can rotate a key drive disk 344, via a key drive tail 346, which linearly slides a slide arm 348, and then rotates a lock drive disk 350 that locks and unlocks the lock mechanism via a lock drive tail 352. Alternatively, sliding the thumb slide 322 can linearly slide the slide arm 348 that rotates the lock drive disk 350 to lock and unlock the lock mechanism via the lock drive tail 352. In addition to the manual actuation methods (e.g., the key cylinder 334 and the thumb slide 322), the lock actuator assembly 304 may also automatically lock and unlock the lock mechanism through the electronic actuator 342. For example, the electronic actuator 342 is configured to drive linear movement of the slide arm 348 that rotates the lock drive disk 350 to lock and unlock the lock mechanism via the lock drive tail 352. This enables operation access through the lock actuator assembly 304 without requiring a physical key.

To operate the electronic actuator 342, the control element 336 that is operatively coupled to the electronic actuator 342 may be used. When the control element 336 is actuated a signal is sent to the electronic actuator 342 to move the slide arm 348 and either lock or unlock the lock mechanism. For example, based on the position of the slide arm 348, the electronic actuator 342 can determine that the lock mechanism is in a locked position, and thus, move the slide arm 348 so that the lock mechanism is in an unlocked position, or determine that the lock mechanism is in an unlocked position, and thus, move the slide arm 348 so that the lock mechanism in a locked position. The electronic actuator 342 may then also display one or more status conditions (e.g., locked or unlocked) of the lock actuator assembly 304 at the notification system 338, which is operatively coupled to the electronic actuator 342. Because the control element 336 is a single button actuator (e.g., touch pad) that is disposed on the exterior side of the lock actuator assembly 304, the lock actuator assembly 304 is easy to operate. In order to lock and unlock the lock mechanism, a user need only to press the control element 336 without having to enter an access code or have a physical key. In other examples, a button, a switch, a sensor, or other signal-sending device may be used in place of the touch pad as required or desired. However, for security and/or any other reasons, the electronic actuator 342 is configured to restrict control of the control element 336 to only authorized users. This enables the electronic actuator 342 to prevent unauthorized access through the door, while still utilizing a single control element 336 for ease of use.

To provide user authorization of the electronic actuator 342 and the lock actuator assembly 304, a security device 354 can be used. The security device 354 may be a mobile device such as a phone or a key fob that can wirelessly communicate with the electronic actuator 342. Before using the electronic actuator 342, one or more security devices 354 can be linked (e.g., authenticated) with the electronic actuator 342 so that access through the door is restricted and not available to everyone. For example, a small aperture (e.g., the size of a paper clip) may be located within the thumb slide 322, which enables access to a small button of the electronic actuator 342 such that when pressed, begins the authentication process for the security device 354. In one example, once the security device 354 is authenticated with the electronic actuator 342, an authentication code can be stored in the security device 354 so that the electronic actuator 342 can search and determine if the security device 354 matches an authorized device when the control element 336 is actuated. In other examples, any other authorization protocols may be used to link the security device 354 and the electronic actuator 342 as required or desired.

When the security device 354 includes key fobs for use with the lock actuator assembly 304, the key fob may be pre-loaded with an authentication code that is uploaded to the electronic actuator 342 for subsequent authorization determinations. Authentication may also be provided by a dedicated computer application on the security device 354 (e.g., mobile phone) that can connect to the electronic actuator 342. Use of the application enables an intuitive user interface to manage authenticated devices with the electronic actuator 342 and facilitate ease of use of the lock actuator assembly 304.

After the initial setup between the security device 354 and the electronic actuator 342, access through the door is easy to operate via the control element 336. Additionally, the communication transmitted between the security device 354 and the electronic actuator 342 can be encrypted with high-level encryption codes and provide resistance to malicious intrusion attempts. In comparison with other systems (e.g., an electronic lock keypad), the user interface is greatly simplified with a control element 336 and use of an application to manage the authenticated device(s).

In other examples, the electronic actuator 342 can be configured (e.g., through the user interface application) to temporarily enable the control element 336 without requiring the security device 354. This can enable third parties (e.g., repair people, dog walkers, movers, etc.) to have temporary access to the sliding door as required or desired while still maintaining security of the lock actuator assembly 304. For example, the control element 336 may be enabled for a predetermined number of uses, a predetermined date/time range for use, or a one-time only use without the security device 354 being present. In still other examples, the electronic actuator 342 may generate temporary authorization codes (e.g., through the user interface application) that can be sent to third parties for temporary access to the sliding door. These temporary authorization codes may be enabled for a predetermined number of uses or a predetermined date/time range for use. To enable control of the electronic actuator 342, one or more printed circuit boards ("PCBs") may be used. For example, the electronic actuator 342 may include three PCBs, a first PCB 355 for control of the slide arm 348 and general external communication, a second PCB 356 coupled to the exterior escutcheon 332 for control of the notification system 338, and a third PCB 357 coupled to the interior escutcheon 318 for control of the device sensor 330. The PCBs 355, 356, and 357 may mechanically support and electrically connect one or more electronic components or electrical components that enables operation of the electronic actuator 342 as described herein. For example, electronic/electrical components may include memory, processors, light emitting diodes (LED), antennas, communication and control components, etc. coupled to the PCB.

The device sensor 330 disposed on the interior lock actuator assembly 310 and includes one or more antennas 359 coupled to the third printed circuit board 357 so that the security device 354 can communicate with the electronic actuator 342 by transmitting and/or receiving communications. The interior lock actuator assembly 310 is described further below in reference to FIG. 5. The antennas 359 can have a predetermined range area (e.g., approximately 10 feet, 15 feet, 20 feet, etc.) such that the security device 354 must be present within the range area in order for the electronic actuator 342 to authorize the security device 354 and to be enabled for the operation of the lock mechanism. In some examples, the range area of the antennas 359 may be user defined in the electronic actuator 342, for example, through the application user interface. By defining the range area of the lock actuator assembly 304, the operation of the lock mechanism can be limited to only when the security device 354 is located proximate the exterior lock actuator assembly 314. This reduces the possibility of the control element 336 being enabled after authorized users leave the sliding door area or when authorized users are merely walking by the sliding door.

In addition to the electronic actuator 342 detecting the presence of the security device 354, the device sensor 330 also can determine the position of the security device 354 relative to the exterior lock actuator assembly 314 so that the electronic actuator 342 is not enabled when authorized users are located on the interior lock actuator assembly 310 side of the sliding door. As such, an unauthorized user cannot lock and/or unlock the lock mechanism when an authorized user is inside and proximate the lock actuator assembly 304. In the example, the device sensor 330 can have two antennas 359 such that the electronic actuator 342 can determine a position of the security device 354 relative to the lock actuator assembly 304 (e.g., towards the interior lock actuator assembly 310 or towards the exterior lock actuator assembly 314). As illustrated in FIG. 4A, the security device 354 is shown in a first operating condition and adjacent to the interior lock actuator assembly 310. In this condition, the antenna 359 that is positioned and directed towards the interior lock actuator assembly 310 receives the strongest signal from the security device 354 such that the electronic actuator 342 can determine that the security device 354 is on the interior of the sliding door. As illustrated in FIG. 4B, the security device 354 is shown in a second operating condition and adjacent to the exterior lock actuator assembly 314. In this condition, the antenna 359 that is positioned and directed towards the exterior lock actuator assembly 314 receives the strongest signal from the security device 354 such that the electronic actuator 342 can determine that the security device 354 is on the exterior of the sliding door. In other examples, the electronic actuator 342 can determine position of the security device 354 relative to the lock actuator assembly 304 by any other method as required or desired (e.g., triangulation, trilateration, multilateration, etc.). Additionally or alternatively, the antennas 359 may be disposed at any other location of the lock actuator assembly 304 as required or desired (e.g., on the second PCB 356 and on the exterior lock actuator assembly 314).

In the example, the interior lock actuator assembly 310 and the exterior lock actuator assembly 314 are mounted proximate to each other and back-to-back on the sliding door. This configuration enables the device sensor 330 range and location determinations to be closely related to the physical position of the security device 354 to the lock actuator assembly 304 and the door. In other examples, however, the device sensor 330 may be remote and separate from the interior lock actuator assembly 310. Additionally, the device sensor 330 may include signal amplifiers and/or directors so that the range and location of the security device 354 can be more accurately determined. In some examples, the amplifiers/directors can be components that are coupled around the antennas 359 or to the interior escutcheon 318 to achieve the desired results.

In operation, upon actuation of the control element 336, the electronic actuator 342 is configured to detect a presence of the security device 354 relative to the lock actuator assembly 304 to verify that the security device 354 is within range; determine a position of the security device 354 relative to the lock actuator assembly 304 (e.g., on the interior or exterior side of the sliding door); and determine whether the security device 354 is authorized for use with the lock actuator assembly 304. When there is an authorized device within range of the electronic actuator 342 and adjacent to the exterior lock actuator assembly 314, the electronic actuator 342 will control the lock mechanism and lock or unlock the sliding door. It should be appreciated that the electronic actuator 342 may perform any of the above operation steps in any sequence as required or desired. For example, the electronic actuator 342 may automatically search for the security devices 354 at predetermined time periods (e.g., every 10 seconds). Thus, the electronic actuator 342 can pre-determine whether an authorized device is present and outside of the lock actuator assembly 304 before the control element 336 is actuated. In other examples, the electronic actuator 342 may first determine authorization of the security device 354 and then determine its relative position before enabling operation of the lock mechanism.

In some examples, the notification system 338 may provide an audible and/or visual indicator during the operation of the lock actuator assembly 304. This enables audible and/or visual feedback for users during control of the lock mechanism by the electronic actuator 342. Additionally or alternatively, an audible and/or visual indicator may also be provided on the interior lock actuator assembly 310. The notification system 338 is described further below in reference to FIG. 8. Furthermore, although the lock actuator assembly 304 is described above in reference to a mortise locking mechanism and a sliding door. It is appreciated that the lock actuator assembly 304 can be coupled to, and used with, any other lock mechanism that is rotatably actuatable and with any other type of door panel as required or desired. Additionally, although the lock actuator assembly 304 is described as having an interior and exterior side, these orientations are merely for reference only. Generally, the lock actuator assembly 304 may be used for any door, gate, or panel that separates a controlled access area from an uncontrolled access area, whether it is inside a structure, outside of a structure, or between the inside and outside of a structure.

The power source compartment 324 is disposed below the thumb slide 322 on the interior lock actuator assembly 310 to provide a power source for the electronic actuator 342. The interior escutcheon 318 defines an opening 358 that enables access to the power source compartment 324, which is positioned between the interior escutcheon 318 and the exterior escutcheon 332. The power source compartment 324 is sized and shaped to receive a battery compartment 382 (shown in FIG. 5) that forms the power source for the lock actuator assembly 304. The power source compartment 324 is accessible through the removable cover 326 and fastener 328 so that the battery compartment can receive new batteries as required or desired. In other examples, the access into the power source compartment 324 may be provided in an orientation from the stile 308 of the door 302 (shown in FIGS. 3A and 3B)

In some examples, because the electronic actuator 342 can unlock the lock mechanism, the key cylinder 334 of the exterior lock actuator assembly 314 can be removed so that there is no manual lock control on the exterior lock actuator assembly 314. In other examples, the thumb slide 322 can additionally or alternatively be removed from the interior lock actuator assembly 310 so that the lock mechanism can only be remotely actuated by the electronic actuator 342.

Figure 5:
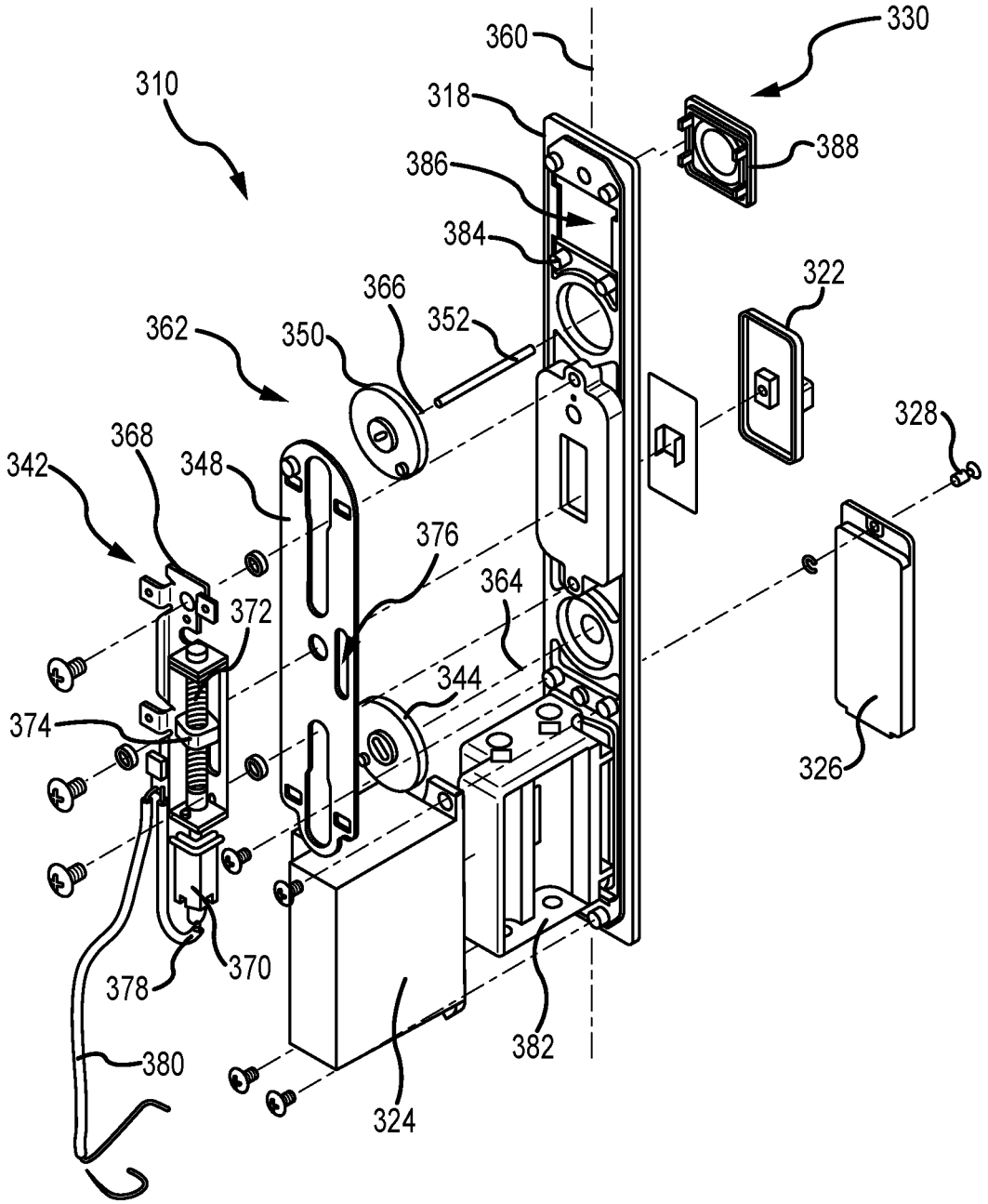
FIG. 5 is an exploded view of an interior lock actuator assembly.

FIG. 5 is an exploded view of the interior lock actuator assembly 310. The interior lock actuator assembly 310 includes the interior escutcheon 318 that defines a longitudinal axis 360. The interior escutcheon 318 supports a lock drive 362 that is configured to couple to the lock mechanism 306 (shown in FIGS. 3A and 3B) such that the lock mechanism can lock and unlock. The lock drive 362 includes the key drive disk 344 rotatably coupled to the interior escutcheon 318 about a first rotational axis 364, the lock drive disk 350 rotatably coupled to the interior escutcheon 318 about a second rotational axis 366, and the slide arm 348 slidingly coupled to the interior escutcheon 318 and operably coupled to both of the key drive disk 344 and the lock drive disk 350. The thumb slide 322 is slidingly coupled to the interior escutcheon 318 and coupled to the slide arm 348. As described above, movement of the slide arm 348 along the longitudinal axis 360 (e.g., via manual rotation of the key drive disk 344 or by the thumb slide 322) rotates the lock drive disk 350 and rotates the lock drive tail 352 to lock and unlock the lock mechanism.

Additionally, the electronic actuator 342 is coupled to the interior escutcheon 318 and is configured to drive the slide arm 348 along the longitudinal axis 360 so as to rotate the lock drive tail 352 and lock and unlock the lock mechanism. In the example, the electronic actuator 342 includes a support plate 368 that is fixed to the interior escutcheon 318 while enabling movement of the lock drive 362. For example, the slide arm 348 can linearly move along the longitudinal axis 360 with respect to the electronic actuator 342 and the drive disks 350, 352 can rotatably move with respect to the electronic actuator 342. The electronic actuator 342 also includes an electronic motor 370, a leadscrew 372 coupled to the motor 370, and a nut 374 threadably engaged with the leadscrew 372. The nut 374 is coupled to the slide arm 348 at an elongated opening 376. In the example, to move the slide arm 348 along the longitudinal axis 360, the motor 370 selectively drives rotation of the leadscrew 372 such that the nut 374 moves along the longitudinal axis 360 and induces movement of the slide arm 348 via the elongated opening 376.

As described herein, the lock drive 362 includes drive disks 344 and 350 and a slide arm 348. In other examples, the lock drive 362 may include any other mechanical linkage that enables the locking mechanism to be locked and unlocked as described herein. For example, a link bar may be used or a set of gears may be used. As such, the electronic actuator 342 may be coupled to one or more components of these mechanical linkage assembly and electronically drive movement thereof. For example, the electronic actuator 342 may be configured to dive movement of the link bar or may be configured to drive movement of the one or more gears.

The support plate 368 is configured to support the first PCB 355 (shown in FIG. 4B). The first PCB is communicatively coupled to the motor 370 by wires 378. Additionally, wires 380 extend between the first PCB and the power source compartment 324 so that power is provided to the electronic actuator 342. The power source compartment 324 houses a battery compartment 382 that is accessible by the removable cover 326 and fastener 328. In the example, the battery compartment 382 can receive four AA batteries, although any other power source can be used as required or desired. The removable battery compartment 382 is configured to be insertable into the power source compartment 324 so that power may be provided to the electronic actuator 342 via one or more electrical leads.

On the opposite end of the interior escutcheon 318 from the power source compartment 324, the device sensor 330 is disposed. The device sensor 330 includes the third PCB 357 (shown in FIG. 4B) that is coupled to the interior escutcheon 318 by one or more supports 384. The third PCB is configured to determine the position and location of the security device as described above and is communicatively coupled to the first PCB. A device sensor opening 386 is defined within the interior escutcheon 318 such that the antennas coupled to the third PCB are disposed proximate the opening 386. The device sensor 330 may include a cover 388 that is coupled around the opening 386. In some examples, the cover 388 may include a gasket that is configured to act as a booster antenna to augment and/or direct wireless signals between the interior lock actuator assembly 310 and the security device such that the device sensor 330 can more easily determine the position of the security device. In other examples, the cover 388 itself may be configured to act as a booster antenna to augment and/or direct wireless signals as required or desired. Additionally or alternatively, the third PCB may include one or more LEDs such that a visual status indicator may be provided at the device sensor 330 and visible through the cover 388.

Figure 6A:
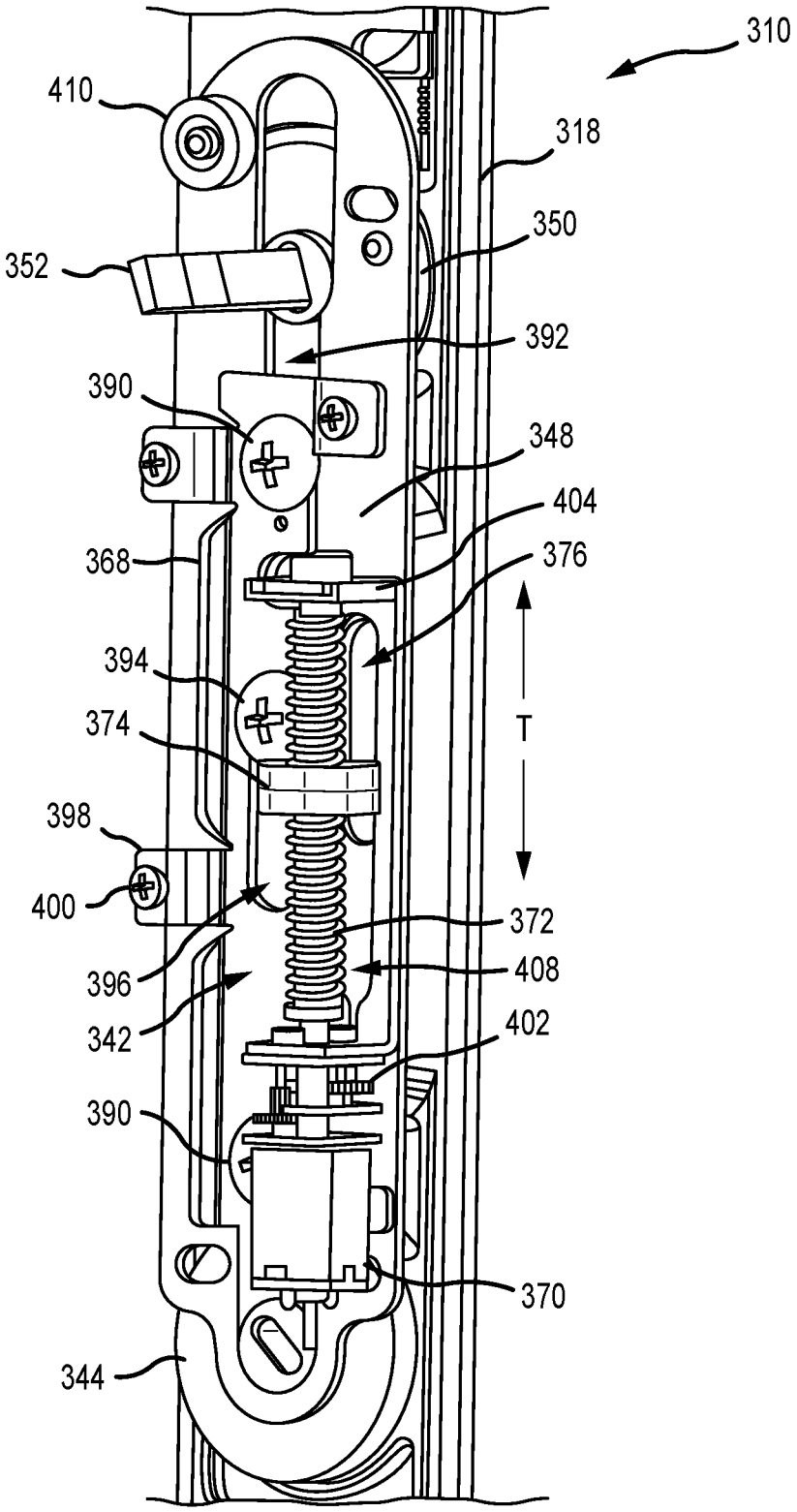
FIGS. 6A-6C are enlarged perspective views of the interior lock actuator assembly.
Figure 6B:
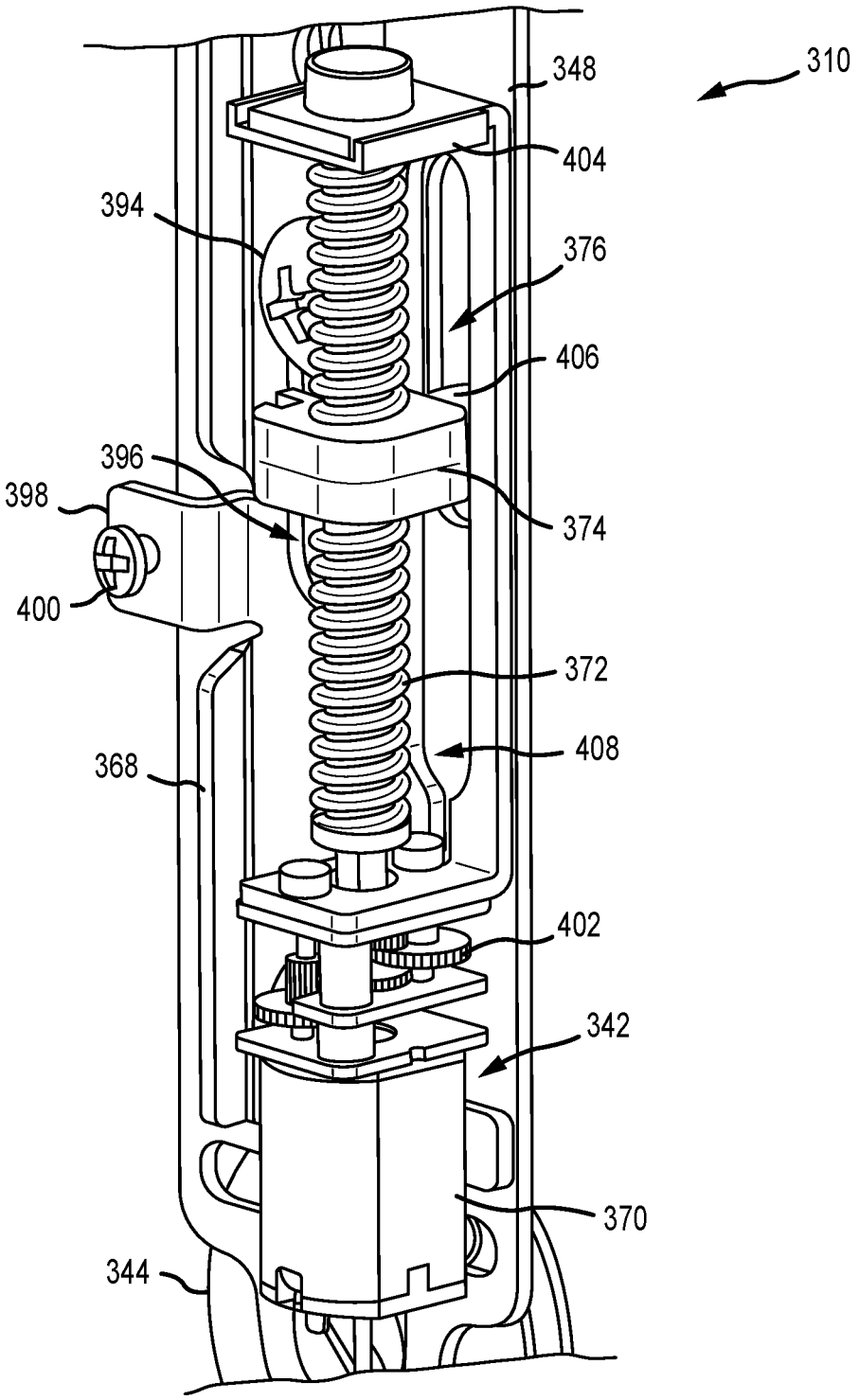
Figure 6C:
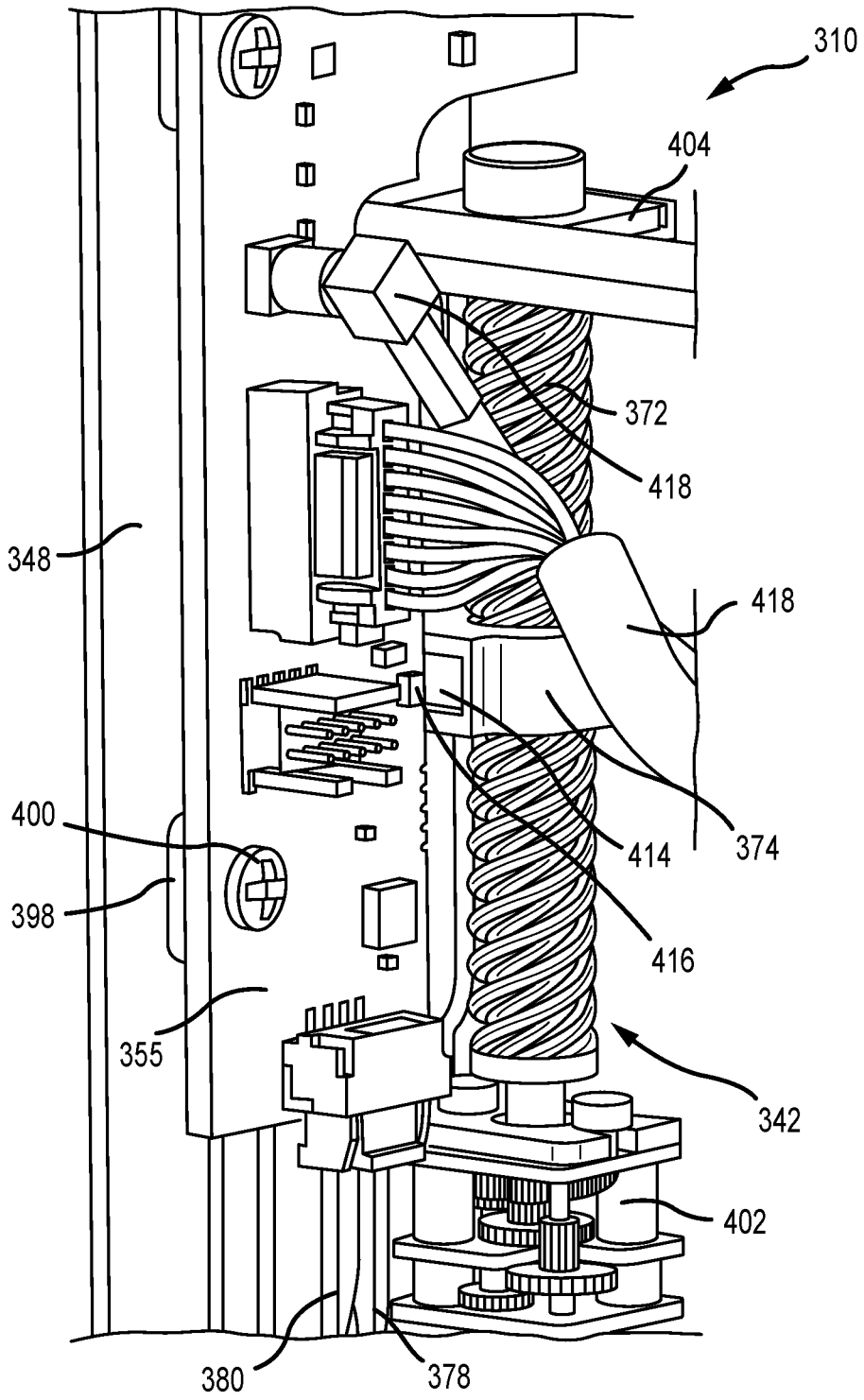

FIGS. 6A-6C are enlarged perspective views of the interior lock actuator assembly 310. Referring concurrently to FIGS. 6A-6C, the support plate 368 of the electronic actuator 342 is mounted to the interior escutcheon 318 by one or more retainers 390 that fix the electronic actuator 342 with respect to the slide arm 348. In the example, the slide arm 348 may be mounted between the electronic actuator 342 and the interior escutcheon 318. The retainers 390 extend through a channel 392 within the slide arm 348 and into the interior escutcheon 318 so that the slide arm 348 can move linearly transversely T within the interior lock actuator assembly 310 and without moving the electronic actuator 342. For example, the key cylinder 334 (shown in FIGS. 4A and 4B) may enable rotation of the key drive disk 344 that moves the slide arm 348 and rotates the lock drive disk 350 and the lock drive tail 352 to operate the lock mechanism. Additionally, the slide arm 348 may be moved by the thumb slide 322 (shown in FIG. 5) which is coupled to the slide arm 348 by a fastener 394. The fastener 394 is disposed at least partially within a channel 396 defined in the support plate 368 such that the length of the channel 396 enables the slide arm 348 and the thumb slide to move in relation to the electronic actuator 342. The support plate 368 may also include one or more tabs 398 configured to receive a screw 400 so that the first PCB 355 (shown in FIG. 6C and not in FIGS. 6A and 6B for clarity) may be attached to the backside of the interior lock actuator assembly 310.

The electronic actuator 342 includes the motor 370 coupled to the support plate 368. The motor 370 is configured to rotationally drive the leadscrew 372 via a gear reduction assembly 402. The leadscrew 372 is rotatably mounted within a bracket 404 formed in the support plate 368 and extends in a direction substantially parallel to the longitudinal axis 360 (shown in FIG. 5). The nut 374 is disposed on the leadscrew 372 and is configured to move linearly along the transverse direction T upon rotation of the leadscrew 372 so that rotational movement of the electronic actuator 342 is translated to linear movement of the slide arm 348. The nut 374 includes a post extension 406 that engages with the slide arm 348 at the elongate opening 376 so as to move the slide arm 348 in the transverse direction T, to rotate the lock drive disk 350, and lock and unlock the lock mechanism as described above. The elongate opening 376 also extends in a direction that is substantially parallel to the longitudinal axis of the interior escutcheon 318. The support plate 368 includes an opening 408 defined along substantially the entire length of the leadscrew 372 proximate the elongate opening 376 so that the nut 374 and post 406 can engage with the slide arm 348 and move along the entire length of the leadscrew 372. Additionally, since the elongate opening 376 is elongated, the thumb slide and/or the key cylinder may still be manually actuated and move the slide arm 348 transversely T to lock and unlock the lock mechanism without forcing movement into the electronic actuator 342.

In operation, the electronic actuator 342 is configured to move the slide arm 348 between two positions. For example, an upper position that moves the slide arm 348 towards the lock drive disk 350 such that the lock mechanism is moved to a locked position and a lower position that moves the slide arm 348 towards the key drive disk 344 such that the lock mechanism is moved to an unlocked position. To enable the slide arm 348 to lock and unlock the lock mechanism, the nut 374 is moveable between three positions along the leadscrew 372, a locking position, an unlocking position, and a center position that is illustrated in FIGS. 6A and 6B. For example, in the locking position, the nut 374 moves towards the lock drive disk 350 so as to move the slide arm 348 and lock the lock mechanism. In the unlocking position, the nut 374 moves towards the key drive disk 344 so as to move the slide arm 348 and unlock the mechanism. After the nut 374 is moved towards the locking position or the unlocking position, the nut 374 always returns to its centered position. This is enabled by the elongated opening 376 of the slide arm 348 so that the slide arm 348 does not move positions when the nut 374 is centered. By having the nut 374 return to a centered position, the thumb slide and/or the key cylinder may then be used to move the slide arm 348 and lock or unlock the lock mechanism without engaging the electronic actuator 342. As such, the lock actuator assembly 304 (shown in FIGS. 3A and 3B) may be manually actuatable, by the thumb slide or key cylinder, or automatically actuatable, by the electronic actuator 342.

The electronic actuator 342 is configured to determine the position of the slide arm 348 (e.g., in the upper position or the lower position) so that it may lock the lock mechanism when it is unlocked and unlock the lock mechanism when it is locked. To determine the position of the slide arm 348, a magnet 410 may be coupled to the slide arm 348 which enables a magnetic sensor 412 (shown in FIG. 4B) disposed on the first PCB 355 (shown in FIGS. 4B and 6C) to sense the position of the slide arm 348 along the longitudinal axis. Additionally, the electronic actuator 342 is configured to determine the position of the nut 374 (e.g., in the locking position, the unlocking position, and the center position) so that it may lock the lock mechanism when it is unlocked and unlock the lock mechanism when it is locked. To determine the position of the nut 374, a magnet 414 (shown in FIG. 6C) may be coupled to the nut 374 which enables a magnetic sensor 416 disposed on the first PCB 355 to sense the position of the nut 374 along the longitudinal axis. In an example, the magnetic sensor 416 may be three different sensors, one positioned at each of the locking position, the unlocking position, and the center position of the nut 374. Accordingly, the motor 370 rotationally drives the leadscrew 372 in the direction required to lock or unlock the lock mechanism as determined by the placement of the slide arm 348 and/or the nut 374. Furthermore, the first PCB 355 is operationally coupled to the third PCB 357 (shown in FIG. 4B) by one or more electrical and communication cables 418, and operationally coupled to the second PCB 356 (shown in FIG. 4A) by one or more electrical and communication cables (not shown).

Figure 7:
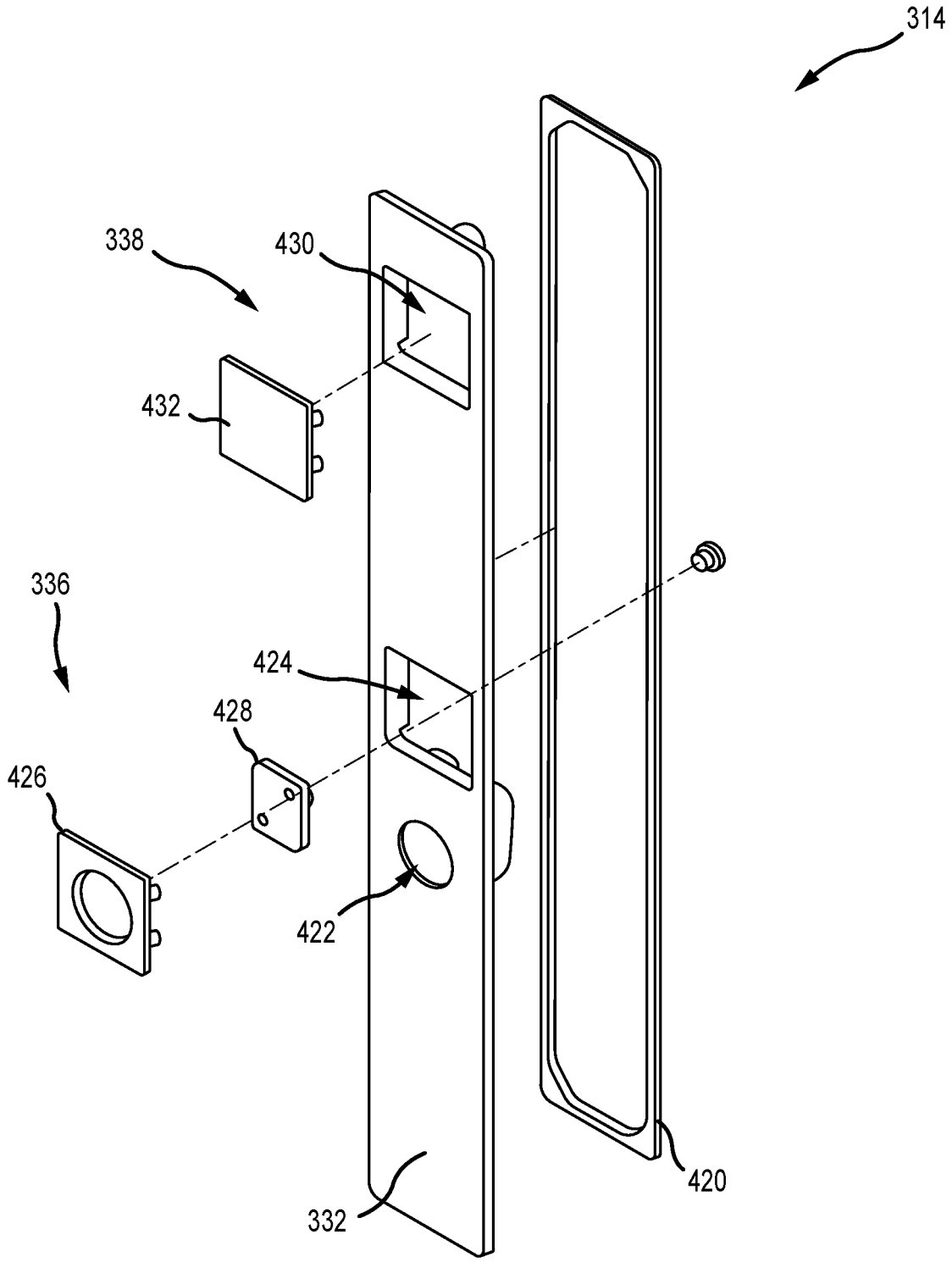
FIG. 7 is an exploded view of an exterior lock actuator assembly.

FIG. 7 is an exploded view of the exterior lock actuator assembly 314. The exterior lock actuator assembly 314 includes the exterior escutcheon 332 that can be mounted to a door surface. A gasket 420 may be provided so as to seal the lock actuator assembly from dirt and moisture. A key cylinder opening 422 is defined in the exterior escutcheon 332 so as to receive the key cylinder 334 (shown in FIG. 3B) and enable manual key actuation of the lock actuator assembly as described herein. A control element opening 424 is also defined in the exterior escutcheon 332 so that the exterior lock actuator assembly 314 supports the control element 336. The control element 336 is configured to be activated so as to begin operation of the electronic actuator 342 (shown in FIGS. 4A and 4B) as described herein. When the control element 336 is a touch pad, the touch pad can includes an insulator 426 that forms the exterior surface of the touch pad and a pad 428 coupled thereto. Upon activation of the touch pad (e.g., by a user), the touch pad sends a signal to the electronic actuator 342 so as to enable operation of the lock actuator assembly. In the example, the touch pad is at least partially recessed with respect to the outer surface of the exterior escutcheon 332 such that the touch pad does not become accidently actuated when sliding against adjacent door panels.

Additionally, a notification opening 430 is defined in the exterior escutcheon 332 so that the notification system 338 can be mounted to the exterior lock actuator assembly 314. The notification system 338 includes the second PCB 356 (shown in FIG. 4A) that has one or more LEDs so as to generate a visual status indicator of the lock actuator assembly. The notification system 338 also includes a cover 432 that is coupled around the opening 430. The cover 432 enables for the visible status indicator to be visible through the cover 432. In some examples, the cover 432 may include a gasket that is configured to act as a booster antenna to augment and/or direct wireless signals between the exterior lock actuator assembly 314 and the security device such that the device sensor 330 (shown in FIG. 5) can more easily determine the position of the security device. In other examples, the cover 432 itself may be configured to act as a booster antenna to augment and direct wireless signals as required or desired.

Figure 8:
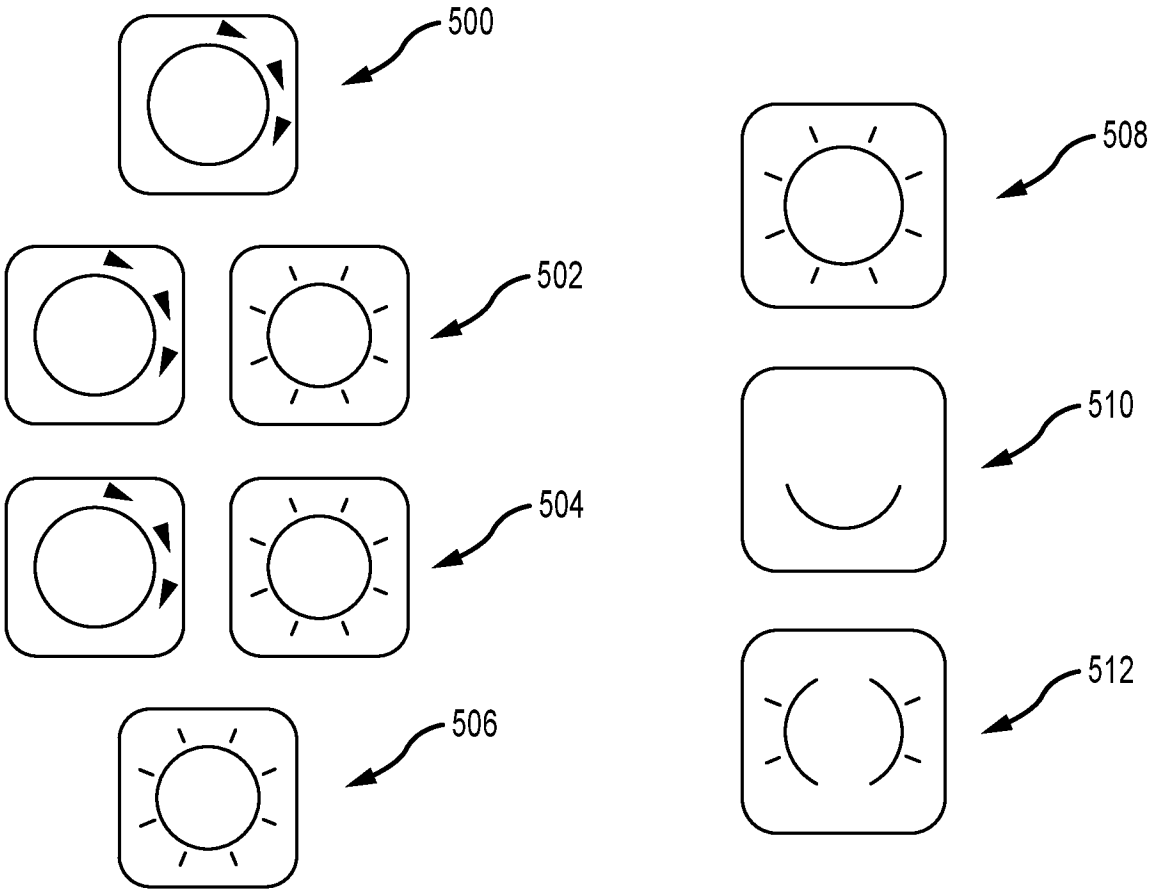
FIG. 8 illustrate exemplary status indicators for use with the lock actuator assembly.

FIG. 8 illustrate exemplary status indicators for use with the notification system 338 of the lock actuator assembly 304 (shown in FIG. 7). The status indicators may be audible (e.g., one or more beeps generated by a sound generator, such as a piezoelectric speaker or the like) or visual (e.g., one or more symbols or colors). In the example, the notification system may include one or more LEDs that can form one or more visual status indicators and illustrate a status condition of the lock actuator assembly to a user. For example, the notification system may illustrate a blue colored spinning illustration 500 to indicate that the lock actuator assembly is authenticating with the security device. A blue spinning illustration followed by a green flash 502 may indicate that the lock actuator assembly has unlocked the lock mechanism. A blue spinning illustration followed by a yellow flash 504 may indicate that the lock actuator assembly has locked the lock mechanism. A magenta flash 506 may indicate that no security device is within range. A red flash 508 may indicate that an unauthorized security device is present. A solid red line 510 may indicate that the power source is low on power and needs to be replaced, and a partial red flash 512 may indicate that the lock actuator assembly has jammed and needs attention. It is appreciated that while a number of exemplary indicators are illustrated, any other combination of colors, shapes, movements, flashes, sounds, etc. may be used as required or desired.

Figure 9:
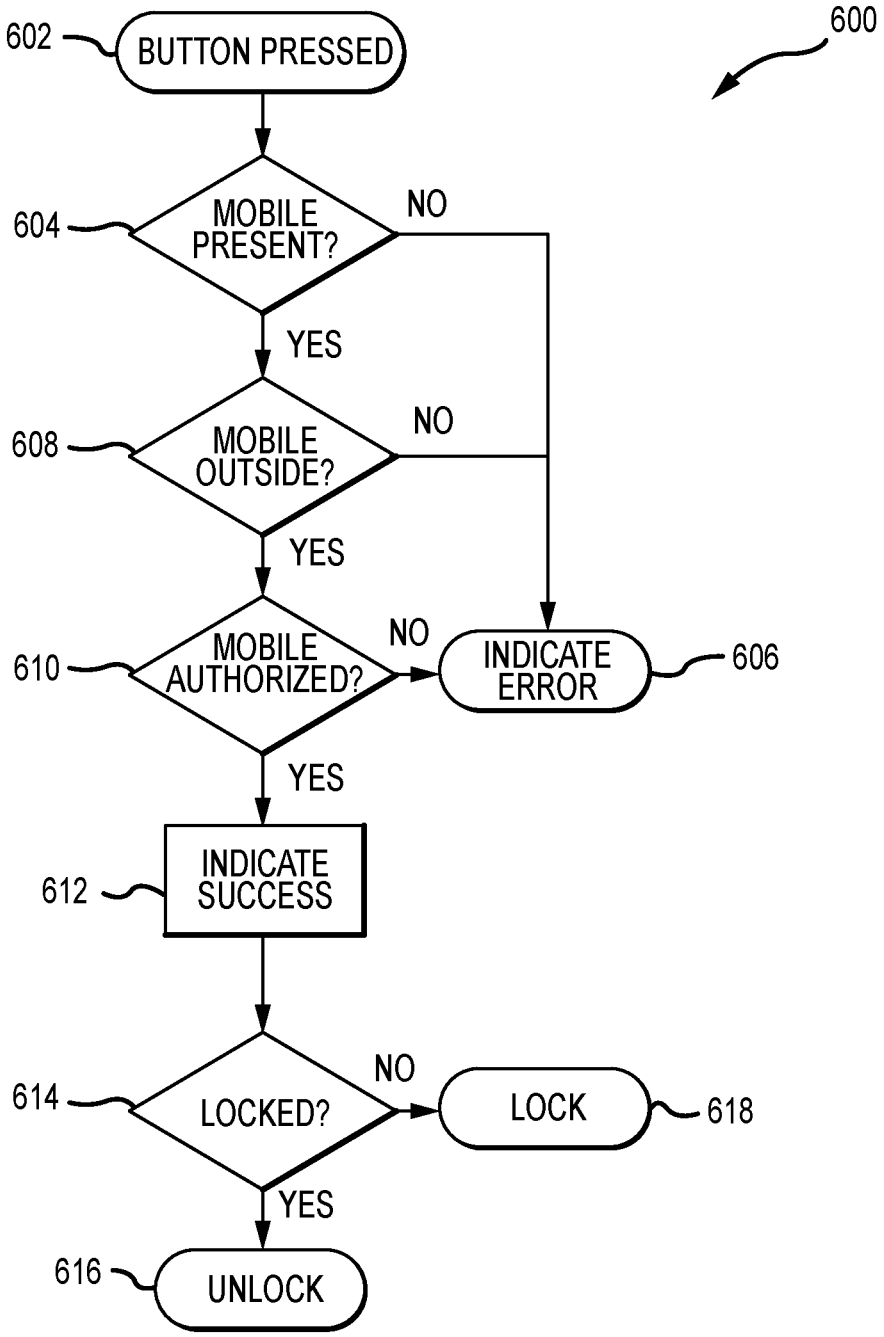
FIG. 9 is flowchart illustrating a method of operating a lock mechanism.

FIG. 9 is flowchart illustrating a method 600 of operating a lock mechanism. The method 600 begins with actuating a control element of a lock actuator assembly (operation 602). Once the control element is pressed a signal is sent and received at an electronic actuator that controls operation of the lock actuator assembly. The control element may be disposed on an exterior escutcheon of the lock actuator assembly and the electronic actuator can be disposed on an interior escutcheon of the lock actuator assembly. Upon receipt of a signal, the electronic actuator detects a presence of a security device relative to the lock actuator assembly (operation 604). If the electronic actuator detects that no security device is present within its range, then a status condition (e.g., an error indication) of the lock actuator assembly may be indicated on the notification system (operation 606).

However, when the electronic actuator detects that there is a security device present, then the electronic actuator determines a position of the security device relative to the lock actuator assembly (operation 608). If the electronic actuator determines that the security device is inside of the door, then a status condition of the lock actuator assembly may be indicated on the notification system (operation 606). However, when the security device is present and outside of the door, then the electronic actuator determines an authorization of the security device (operation 610). If the electronic actuator determines that the security device is unauthorized, then a status condition of the lock actuator assembly may be indicated on the notification system (operation 606).

When the security device is positioned proximate the lock actuator assembly, located on the exterior escutcheon, and authorized to operate the lock actuator assembly, the electronic actuator can move a lock drive coupled to the lock mechanism via a motor and indicate a status condition (e.g., a success indication) of the lock actuator assembly on the notification system (operation 612). For example, the success indication can be a notification that the lock mechanism is locking if originally unlocked or unlocking if originally locked. In some examples, moving the lock drive can further include moving a nut coupled to the lock drive along a rotating leadscrew, and after moving the lock mechanism to one of a locked position and an unlocked position, the nut returning to a center position. While operations 604, 608, 610 are illustrated as being in order in FIG. 9, it is appreciated that these operations may be performed at any time and in any order as required or desired. Once the locking mechanism is to be locked or unlocked, the method 600 further includes sensing a position of the lock mechanism by a sensor (operation 614). As such, when the lock mechanism is locked, the electronic actuator operates the lock mechanism to unlock (operation 616), and when the lock mechanism is unlocked, the electronic actuator operates the lock mechanism to lock (operation 618).

The materials utilized in the manufacture of the lock assemblies described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.). Additionally, the lock described herein is suitable for use with doors constructed from vinyl plastic, aluminum, wood, composite, or other door materials.

Any number of features of the different examples described herein may be combined into one single example and alternate examples having fewer than or more than all the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A lock actuator assembly comprising:

an escutcheon defining a longitudinal axis;

a rotatable drive disk rotatably coupled to the escutcheon about a rotational axis;

a slide arm slidingly coupled to the escutcheon and operably coupled to the drive disk, wherein movement of the slide arm along the longitudinal axis rotates the drive disk about the rotational axis; and an electronic actuator coupled to the escutcheon, wherein the electronic actuator comprises a support plate fixed to the escutcheon and a motor supported on the support plate, the slide arm disposed between the support plate and the escutcheon in a direction along the rotational axis, wherein the motor of the electronic actuator is configured to drive the slide arm along the longitudinal axis, and wherein the drive disk is adapted to couple to a lock mechanism so as to shift the lock mechanism between a locked position and an unlocked position when the drive disk rotates about the rotational axis.

2. The lock actuator assembly of claim 1, wherein the electronic actuator further comprises:

a leadscrew coupled to the motor; and a nut threadably engaged with the leadscrew and coupled to the slide arm, wherein the motor selectively drives rotation of the leadscrew such that the nut moves along the longitudinal axis and induces the movement of the slide arm.

3. The lock actuator assembly of claim 2, wherein the leadscrew extends in a direction substantially parallel to the longitudinal axis.

4. The lock actuator assembly of claim 2, wherein the nut comprises a post engaged with an opening defined in the slide arm.

5. The lock actuator assembly of claim 4, wherein the opening is elongated along the longitudinal axis.

6. The lock actuator assembly of claim 2, wherein the electronic actuator further comprises a sensor configured to determine a position of the nut along the longitudinal axis.

7. The lock actuator assembly of claim 1, further comprising a control element operatively coupled to the electronic actuator.

8. The lock actuator assembly of claim 7, further comprising a notification system operatively coupled to the electronic actuator.

9. The lock actuator assembly of claim 8, wherein the escutcheon is an interior escutcheon, and wherein the lock actuator assembly further comprises an exterior escutcheon comprising the control element and the notification system.

10. The lock actuator assembly of claim 1, further comprising a thumb slide coupled to the slide arm, wherein the thumb slide is configured to move along the longitudinal axis and induces the movement of the slide arm.

11. The lock actuator assembly of claim 1, further comprising a key cylinder coupled to the slide arm, wherein rotation of the key cylinder is configured to move the slide arm along the longitudinal axis.

12. A lock actuator assembly comprising:

an escutcheon mountable on an inner surface of a sliding door;

a lock drive mounted to the escutcheon and adapted to couple to a lock mechanism that mounts to a stile of the sliding door; and an electronic actuator comprising a support plate mounted to the escutcheon and a motor supported on the support plate, the electronic actuator coupled to the lock drive and the lock drive is disposed between the support plate and the escutcheon, wherein the motor of the electronic actuator is configured to move the lock drive between at least two positions, a first position corresponding to a locked position of the lock mechanism and a second position corresponding to an unlocked position of the lock mechanism.

13. The lock actuator assembly of claim 12, wherein the electronic actuator further comprises a rotatable leadscrew and a nut threadably engaged to the leadscrew and coupled to the lock drive, wherein the nut is moveable between three positions, a locking position, an unlocking position, and a center position, wherein when the nut moves towards the locking position, the lock drive moves to the first position, and when the nut moves towards the unlocking position, the lock drive moves to the second position, and wherein the nut returns to the center position after the locking position and the unlocking position.

14. The lock actuator assembly of claim 12, wherein the electronic actuator further comprises a control element, and wherein when the control element is activated, the electronic actuator searches for a security device before moving the lock drive.

15. The lock actuator assembly of claim 14, wherein the electronic actuator further comprises at least one antenna configured to detect the security device.

16. The lock actuator assembly of claim 12, wherein the electronic actuator comprises a notification system configured to display at least one status condition of the electronic actuator.

17. The lock actuator assembly of claim 12, further comprising at least one of a thumb slide mounted to the escutcheon and coupled to the lock drive and a key cylinder coupled to the lock drive.

18. A method of operating a lock mechanism comprising:

receiving an activation signal from a control element at an electronic actuator, wherein the control element is disposed on an exterior escutcheon of a lock actuator assembly that is mounted on an exterior surface of a door and the electronic actuator is disposed on an interior escutcheon of the lock actuator assembly that is mounted to an interior surface of the door;

detecting, by the electronic actuator, a presence of a security device relative to the lock actuator assembly;

determining, by the electronic actuator, a position of the security device relative to the lock actuator assembly;

determining, by the electronic actuator, an authorization of the security device; and moving a lock drive mounted to the interior escutcheon and coupled to the lock mechanism based on the security device being (i) positioned proximate the lock actuator assembly; (ii) located at the exterior escutcheon; and (iii) authorized to operate the lock actuator assembly, wherein the electronic actuator includes a support plate mounted to the interior escutcheon and a motor supported on the support plate, and wherein the lock drive is disposed between the interior escutcheon and the support plate and the motor is coupled to the lock drive such that the lock drive linearly and rotationally moves to operate the lock mechanism.

19. The method of claim 18, further comprising displaying a visual signal from a notification system disposed on the exterior escutcheon based on at least one status condition of the electronic actuator.

20. The method of claim 18, wherein moving the lock drive comprises linearly moving a nut coupled to the lock drive along a rotating leadscrew, and wherein after moving the lock mechanism to one of a locked position and an unlocked position, the nut returns to a center position.

* * * * *